US006114638A

United States Patent [19]

Naganuma et al.

[11] Patent Number: 6,114,638

[45] Date of Patent: Sep. 5, 2000

[54] ROTARY SWITCH DEVICE

[75] Inventors: Yasunori Naganuma; Masahiko Harada; Kazuyoshi Oomura; Yuuichi Naganuma, all of Miyazaki, Japan

[73] Assignee: Kabushiki Kaisha Honda Lock, Miyazaki, Japan

[21] Appl. No.: 09/256,235

[22] Filed: Feb. 24, 1999

[30] Foreign Application Priority Data

| | | | |
|---|---|---|---|
| Feb. 24, 1998 | [JP] | Japan | 10-042251 |
| Feb. 24, 1998 | [JP] | Japan | 10-042252 |
| Feb. 24, 1998 | [JP] | Japan | 10-042253 |
| Feb. 24, 1998 | [JP] | Japan | 10-042254 |
| Feb. 24, 1998 | [JP] | Japan | 10-042255 |
| Feb. 24, 1998 | [JP] | Japan | 10-042256 |
| Feb. 24, 1998 | [JP] | Japan | 10-042257 |
| Feb. 24, 1998 | [JP] | Japan | 10-042258 |

[51] Int. Cl.[7] ..... H01H 19/10

[52] U.S. Cl. ..... 200/6 R; 200/11 R; 200/11 A; 200/11 D

[58] Field of Search ..... 200/4, 5 R, 6 R, 200/11 R–11 K, 17 R, 18, 564, 565, 570, 571, 284, 292, 336, 242, 253

[56] References Cited

U.S. PATENT DOCUMENTS

| | | | |
|---|---|---|---|
| 4,045,637 | 8/1977 | Mongeau | 200/303 |
| 4,218,594 | 8/1980 | Komatsu et al. | 200/11 G |
| 4,897,513 | 1/1990 | Oka et al. | 200/11 EA |
| 5,743,380 | 4/1998 | Gauker | 200/43.08 |
| 5,847,345 | 12/1998 | Harrison | 200/284 |

FOREIGN PATENT DOCUMENTS

| | | | |
|---|---|---|---|
| 1-29959 | 9/1989 | Japan | H01H 27/06 |

*Primary Examiner*—Michael Friedhofer
*Attorney, Agent, or Firm*—Arent Fox Kintner Plotkin & Kahn PLLC

[57] ABSTRACT

A rotary switch device in which fixed contacts are fixed to one face side of a base member made of a synthetic resin, contact plates in a ring shape are floatingly held by a rotor disposed opposed to the one face side of the base member, movable contacts capable switching the connection and disconnection to and from the fixed contacts in accordance with the rotation of the rotor are integrally formed at a plurality of places spaced from each other at circumferential intervals on the contact plates, and sliding faces capable of being brought into slide contact with the movable contacts are formed on the one face of the rotor side of the base member, along a plane orthogonal to the rotation axis of the rotor. The sliding faces are formed in the base member so as to avoid the loci which are drawn by portions of the movable contacts to be brought into slide contact with the fixed contacts in accordance with the rotation of the rotor. Thereby, foreign objects are prevented from being interposed between the movable contacts and the fixed contacts when the switch is ON, and the electrical connection reliability can be enhanced.

8 Claims, 17 Drawing Sheets

ROTARY SWITCH DEVICE

BACKGROUND OF THE INVENTION

1. Field of the Invention

The present invention relates to a rotary switch device, particularly to a rotary switch device in which fixed contacts are fixed to one of opposite face side of a base member made of a synthetic resin, a contact plate in a ring shape is floatingly held by a rotor disposed opposed to the one face side of the base member, movable contacts capable of switching the connection and disconnection to and from the fixed contacts in accordance with the rotation of the rotor are integrally formed at a plurality of places spaced from each other at circumferential intervals on the contact plate, and sliding faces capable of being brought into slide contact with the movable contacts are formed along a plane perpendicular to the rotation axis of the rotor on one of opposite faces of the base member on the rotor side.

2. Description of Related Art

Conventionally, there has already been known such a rotary switch by Japanese Utility Model Publication No. 1-29959 and the like, and in such a device, sliding faces are formed in a base member in such a manner that portions of movable contacts to be brought into slide contact with fixed contacts can also be brought into slide contact with the sliding faces. Therefore, foreign objects produced by wear of the sliding faces resulting from slide contact of the movable contacts with the sliding faces are brought onto the fixed contacts by the rotation of the rotor and there is a possibility that the reliability of electrical connection may deteriorate by the foreign objects being caught between the movable contacts and the fixed contacts while the switch is ON.

SUMMARY OF THE INVENTION

The present invention has been made in view of such a situation and it is an object thereof to provide a rotary switch device with improved electrical connection reliability by preventing foreign matters from being caught between movable contacts and fixed contacts while the switch is ON.

According to a first feature of the invention, a rotary switch device is provided in which fixed contacts are fixed on one of opposite face sides of a base member made of a synthetic resin, a contact plate in a ring shape is floatingly held by a rotor disposed opposed to the one face side of the base member, movable contacts capable of switching the connection and disconnection to and from the fixed contacts in accordance with the rotation of the rotor are integrally formed at a plurality of places spaced from each other at circumferential intervals on the contact plate, and sliding faces capable of being brought into slide contact with the movable contacts are formed on one of opposite faces of the base member closer to the rotor along a plane orthogonal to a rotation axis of the rotor, wherein the sliding faces are formed on the base member so as to avoid loci which are drawn by portions of the movable contacts to be brought into slide contact with the fixed contacts in accordance with the rotation of the rotor.

With the arrangement of the first feature, the portions of the movable contacts to be brought into slide contact with the fixed contacts are not brought into slide contact with the sliding faces, even when the sliding faces are worn and foreign matters are produced in accordance with the slide contact of the movable contacts with the sliding faces, the foreign matters are prevented from being brought onto the fixed contacts by the rotation of the rotor and the electrical connection reliability can be improved.

According to a second feature of the invention, in addition to the arrangement of the above first feature, a rotary switch device is provided in which springs for exerting spring forces to bias the movable contacts toward the base member are provided between the contact plates and the rotor, a case made of a synthetic resin being in contact with the one face side of the base member to support the rotor rotatably between the case and the base member is integrally provided with a plurality of leg portions respectively inserted into a plurality of engaging holes provided in the base member, engaging claws engaged with the other of the opposite faces of the base member are outward projected from tip ends of the leg portions, and a cover made of a synthetic resin covering at least bonding portions of lead wires connected to the respective fixed contacts on the other face side of the base member is integrally provided with a plurality of come-off preventive portions fitted to the respective engaging holes so as to be interposed between the base member and the respective leg portions.

With the arrangement of the second feature, since the engaging claws directed outwardly for engaging with the base member are provided at the leg portions integrally provided on the case, the die for forming the case need not be provided with a sliding die which has conventionally been necessary, and simplification of the die structure can be achieved. Further, since the plurality of come-off preventive portions fitted to the engaging holes and interposed between the leg portions inserted into the respective engaging holes and the base member are provided integrally with the cover, even when the numbers of engaging holes, leg portions and engaging claws are made comparatively small, there can be excluded a possibility of releasing engagement between the engaging claws and the base member even with stress relaxation at high temperature, the work of assembling the case to the base member is facilitated and the assembling workability can be enhanced. Further, since the cover covers at least the connecting portions of the lead wires bonded to the fixed contacts, the insulation reliability at the connecting portions can be improved.

According to a third feature of the invention, in addition to the arrangement of the first feature, a rotary switch device is provided in which a plurality of bus bars integrally having the fixed contacts and embedded in the base member are integrally provided with terminal portions arranged parallel to each other so as to face the other of opposite faces of the base member in such a way that conductors of lead wires can directly be bonded to the terminal portions, and a cover made of a synthetic resin for covering at least portions of connecting the lead wires to the respective terminal portions on the side of the other face of the base member is integrally provided with partitioning walls for partitioning areas where the terminal portions and the conductors are bonded, respectively.

With the arrangement of the third feature, since the plurality of bus bars embedded in the base member are respectively and integrally provided with the fixed contacts and the terminal portions, the conductors of the lead wires are respectively and directly bonded to the plurality of terminal portions arranged in parallel on the other face side of the base member, the workability can be enhanced in bonding the lead wires to the respective fixed contacts. Further, since not only the cover covering the other face side of the base member covers the bonding portions where the terminal portions and the respective lead wires are bonded but the partition walls integrally provided to the cover partition the areas where the terminal portions and the lead wires are joined, shortcircuit can be prevented from occurring between the bonding portions, and the insulation reliability can be improved.

According to a fourth feature of the invention, in addition to the arrangement of the first feature, the rotary switch device is provided in which a plurality of bus bars integrally provided with the fixed contacts and embedded in the base member are integrally provided with terminal portions having bonding faces facing the other of opposite faces of the base member and arranged parallel to each other in such a way that conductors of lead wires corresponding to the respective terminal portions can directly be bonded to the bonding faces, and the base member is integrally provided with a holding portion for holding the lead wires in a direction forming an angle to the bonding faces in a plane orthogonal to a direction of arrangement of the terminal portions.

With the arrangement of the fourth feature, the plurality of bus bars embedded in the base member are integrally provided with the fixed contacts and the terminal portions, and the conductors of the lead wires are directly bonded to the bonding faces of the plurality of terminal portions arranged in parallel on the other face side of the base member. Accordingly, the workability can be enhanced in bonding the lead wires to the respective fixed contacts. Further, by the holding portion provided to the base member, the wires are held in the direction forming an angle to the bonding faces in a plane orthogonal to the direction of arrangement of the terminal portions, the tensile load on the lead wires outside the rotary switch device is prevented from directly acting on the bonding portions where the lead wires are bonded to the respective terminal portions, and the lead wires are not repeatedly bent between the holding portion and the terminal portions. Therefore, strict strength guarantee required at the bonding portions where the conductors of the respective lead wires are bonded to the bonding faces is not necessary. Further, in a state in which the lead wires are held by the holding portion, the conductors of the lead wires can directly be bonded to the bonding faces of the respective terminal portions and accordingly, positioning of the lead wires in the bonding is facilitated and connection workability can further be enhanced.

According to a fifth feature of the invention, in addition to the fourth feature, bonding portions of the lead wires bonded to the respective terminal portions on the other face of the base member are covered with a cover made of synthetic resin, the holding portion has a plurality of fitting grooves each comprising a first groove portion opened to the cover and a second groove portion opened to the outer side of the base member and connected to the first groove portion in a generally L-shape in such a way that the respective lead wires can be resiliently fitted therein, and the cover is integrally provided with a restraining wall for restraining the respective lead wires between the cover and at least the second groove portion of the fitting grooves. With the fifth feature, the lead wires can firmly be restrained around the portions of the lead wires bonded to the terminal portions, and the bonding of the conductors of the lead wires to the bonding faces can be maintained further firmly.

According to a sixth feature of the invention, in addition to the first feature, a plurality of bus bars integrally provided with the fixed contacts and embedded in the base member are integrally provided with terminal portions, each of the terminal portions has a cross section formed in a generally U-shape so that conductors of lead wires are fitted to the terminal portions, and the conductors fitted to the terminal portions are bonded to the respective terminal portions by thermocompression bonding using planar electrodes for clamping the conductors between the electrodes and the respective terminal portions.

According to the arrangement of the sixth feature, the terminal portions integrally provided to the plurality of bus bars are formed of a generally U-shape cross-section to fit the conductors of the lead wires and accordingly, part of the conductors can simply be prevented from protruding from the terminal portions, and the conductors can be clamped easily between the terminal portions and the electrodes, and the bonding workability can be enhanced. Further, the electrodes are formed in a simple planar shape and accordingly, the maintenance thereof is facilitated.

According to a seventh feature of the invention, in addition to the arrangement of the first feature, a plurality of bus bars integrally provided with the fixed contacts are embedded in the base member and the other face of the base member is provided with a plurality of opening portions for exposing the respective bus bars to an outside. With the arrangement of the seventh feature, the bus bars embedded in the base member are positively exposed to the outside on the other face side of the base member, an increase in the allowable current can be achieved by improving the heat radiating ability of the bus bars, the amount of synthetic resin necessary for molding the base member can be reduced by providing the plurality of opening portions in the base member, the bus bars can be supported by the respective opening portions in molding the base member and accordingly, the positions of the bus bars relative to the base member can be determined more accurately.

According to an eighth feature of the invention, in addition to the arrangement of the first feature, the bus bars which are integrally provided with flat plate portions along a plane orthogonal to a rotation axis of the rotor and side plate portions orthogonally connected to the flat plate portions are embedded in the base member, and the flat plate portions of the bus bars are integrally provided with the fixed contacts.

With the arrangement of the eighth feature, the bus bars embedded in the base member are integrally provided with the flat plate portions and the side plate portions orthogonally connected to the flat plate portions and accordingly, the surface areas of the bus bars can be increased while comparatively decreasing the areas occupied by the bus bars in a plane orthogonal to the rotation axis of the rotor and accordingly, heat radiating ability can be enhanced while comparatively decreasing the areas where the bus bars are provided.

According to a ninth feature of the invention, in addition to the arrangement of the first feature, a plurality of bus bars are connected to each other via connecting portions which are cut in accordance with the formation of through holes by punching after molding the base member, the bus bars being integrally provided with the fixed contacts and embedded in the base member, a cover for covering the base member from a side opposite to the rotor is provided with a plurality of heat radiating openings, and bosses for closing the through holes are integrally formed with the cover so as to project to the base member side.

With the arrangement of the ninth feature, the cover is provided with the plurality of heat radiating openings and accordingly, the ability to radiate heat from the cover is enhanced, heat is prevented from being accumulated in the region between the cover and base member and an increase in the allowable current of the bus bars can be achieved.

Further, the bosses for closing the through holes are integrally provided with the cover and accordingly, despite the provision of the heat dissipating openings in the cover, foreign objects can be prevented from entering the space between the base member and the rotor through the through holes.

The above-described and other objects, features, and advantages of the invention will become apparent from description of a preferred embodiment described in details in reference to the attached drawings as follows.

BRIEF DESCRIPTION OF THE DRAWINGS

FIGS. 1 to 20 show an embodiment when the invention is applied to an ignition switch for a vehicle, wherein:

FIG. 1 is a longitudinal sectional view of an ignition switch taken along a line 1—1 of FIG. 2;

FIG. 2 is a view when viewed in the direction of arrow 2 of FIG. 1;

FIG. 3 is a sectional view taken along a line 3—3 of FIG. 2;

FIG. 4 is a front view of the ignition switch when viewed in the direction of arrow 4—4 of FIG. 1;

FIG. 5 is an exploded side view of the ignition switch when viewed in the direction of arrow 5 of FIGS. 2 and 4;

FIG. 6 is a view of a first contact plate when viewed in the direction of arrow A of FIG. 5;

FIG. 7 is a view of a second contact plate when viewed in the direction of arrow A of FIG. 5;

FIG. 8 is a front view of a base member when viewed in the direction of arrow 8 of FIG. 5;

FIG. 9 is a rear view of the base member when viewed in the direction of arrow 9 of FIG. 5;

FIG. 10 is a sectional view taken along a line 10—10 of FIG. 8;

FIG. 11 is an enlarged sectional view taken along a line 11—11 of FIG. 8;

FIG. 12 is an enlarged sectional view taken along a line 12—12 of FIG. 4;

FIG. 13 is an enlarged sectional view taken along a line 13—13 of FIG. 4;

FIG. 14 is a front view of bus bars embedded in the base member in the same direction in which the base member of FIG. 8 is viewed;

FIG. 15 is a perspective view of the bus bars embedded in the base member;

FIG. 16 is a sectional view taken along a line 16—16 of FIG. 4;

FIG. 17 is a sectional view developed in a peripheral direction showing the relative positions of a first through a third fixed contact and a first through a third movable contact at a LOCK position;

FIG. 18 is a sectional view developed in a peripheral direction showing the relative positions of a fourth through a sixth fixed contact and a fourth through a sixth movable contact at a LOCK position;

FIG. 19 is an enlarged sectional view taken along a line 19—19 of FIG. 4.

DETAILED DESCRIPTION OF THE PREFERRED EMBODIMENT

Figure 1:
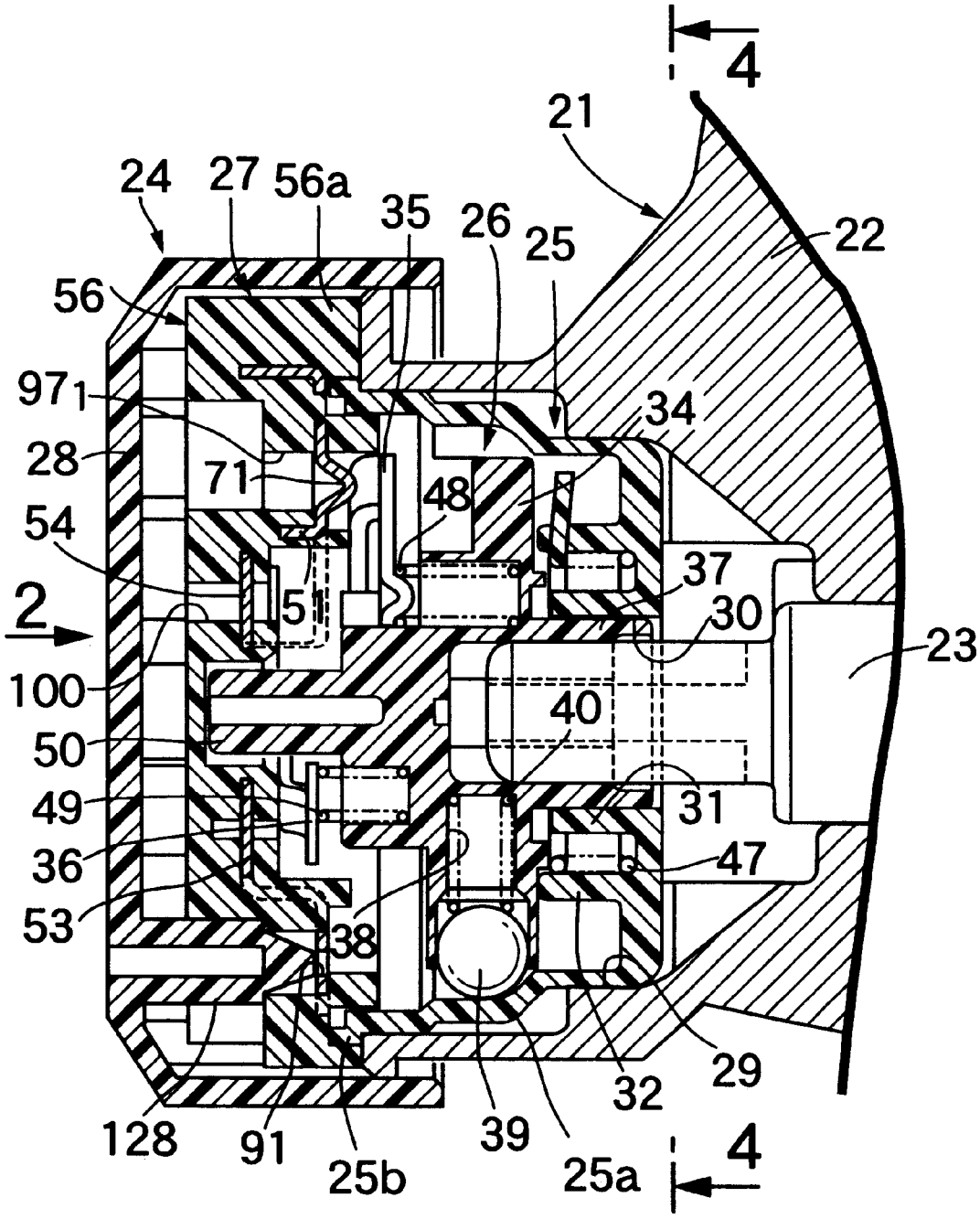
Figure 2:
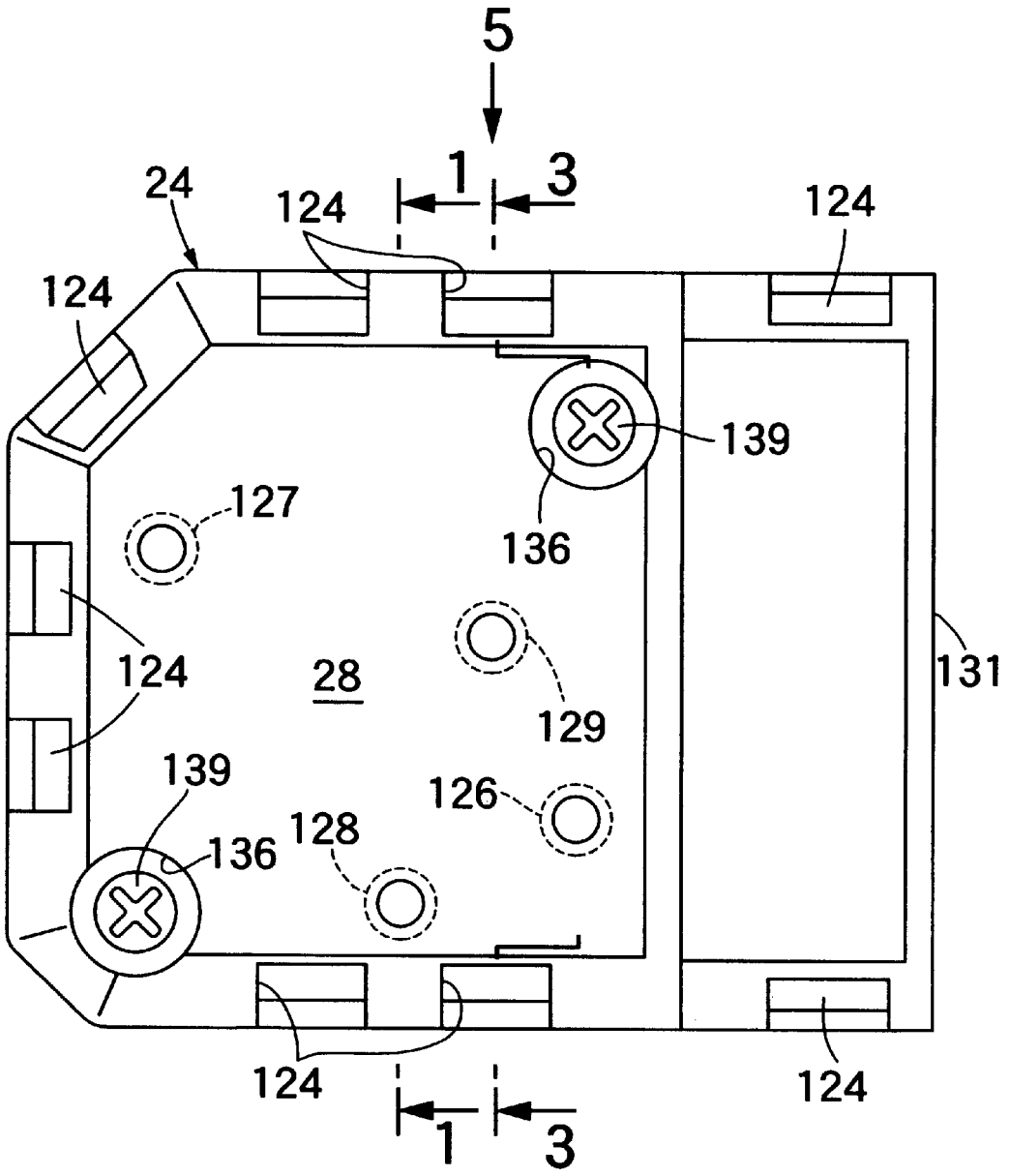

Describing an embodiment of the invention in reference to FIGS. 1 to 20, firstly, in FIG. 1, a casing 22 of a cylinder lock apparatus 21 for controlling the start and stop of an engine and electric equipment of a vehicle, is attached to a steering column, not illustrated, a rotary member 23 for rotating a key, not illustrated, in accordance with the operation of the key to a position out of a LOCK position, an ACC position, an ON position and a START position, is disposed within a front end portion of the casing 22, and an ignition switch 24 as a rotary switch device for switching incident to the rotation of the rotary member 23 is connected to the rotary member 23 and attached to the front end portion of the casing 22.

In reference to FIGS. 2 to 5, the ignition switch 24 is provided with a case 25 made of a synthetic resin, a movable contact assembly 26, a fixed contact assembly 27 and a cover 28 made of a synthetic resin. The movable contact assembly 26 is rotatably supported between the case 25 and the fixed contact assembly 27 which are engaged and connected with each other. The cover 28 covering the fixed contact assembly 27 from the opposite side to the case 25, the fixed contact assembly 27, and the case 25 are fastened to the casing 22.

The case 25 is integrally provided with a case main portion 25*a* formed in a bowl-like shape and a flange portion 25*b* projecting from an opening end of the case main portion 25*a* to the outside, the case main portion 25*a* is fitted to an attaching recess portion 29 provided in the front end portion of the casing 22 such that the opening end of the case main portion 25*a* is directed to the opposite side to the casing 22 and the flange portion 25*b* is in contact with the front end face of the casing 22.

A circular through hole 30 is made at a central portion of a closed end of the case main portion 25*a,* a first cylindrical support portion 31 coaxially connected with the through hole 30 and a second cylindrical support portion 32 coaxially surrounding the first support portion 31 are projected from the inner face of the closed end of the case main body 25*a,* and front ends of the both support portions 31 and 32 are located at the same position along the axis of the through hole 30. Further, the flange portion 25*b* is provided with a pair of insertion holes 33, . . . arranged on a diameter of the through hole 30.

The movable contact assembly 26 is comprised of a first and a second contact plate 35 and 36 made of conductive metal floatingly supported by a rotor 34 made of a synthetic resin. The rotor 34 is integrally provided with a connecting cylinder portion 37 fitted to the first support portion 31 of the case 25 and the rotary member 23 inserted into the through hole 30 of the case 25 is connected to the connecting cylinder portion 37 such that the both cannot be moved angularly relative to each other. That is, the rotor 34 is rotated in accordance with the rotation of the rotary member 23.

Support holes 38, . . . each extended in a radial direction of the rotor 34 and having an open outer end are made at two locations of an outer peripheral portion of the rotor 34 spaced from each other at an interval in the peripheral direction, spherical bodies 39 are inserted into outer end portions of the respective support holes 38, . . . and springs 40 for biasing the spherical bodies 39, . . . toward the inner face side of the case main portion 25*a* are provided between closed portions of inner ends of the support holes 38, . . . and the spherical members 39 . . . Meanwhile, a plurality of recess portions (not illustrated) for fitting part of the spherical members 39, . . . are provided on the inner face of the case main portion 25*a*. Thereby, the rotor 34 is rotated in steps to one of the positions of the LOCK position, the ACC position, the ON position and the START position in accordance with the rotation of the rotary member 23.

A torsion spring 47 is inserted between the first and the second support portions 31 and 32 of the case main portion 25*a* and both ends of the torsion spring 47 are respectively engaged with the rotor 34 and the case main portion 25*a*. By the spring force of the torsion spring 47, the rotor 34 is rotatingly biased to return from the START position to the ON position.

Figure 6:
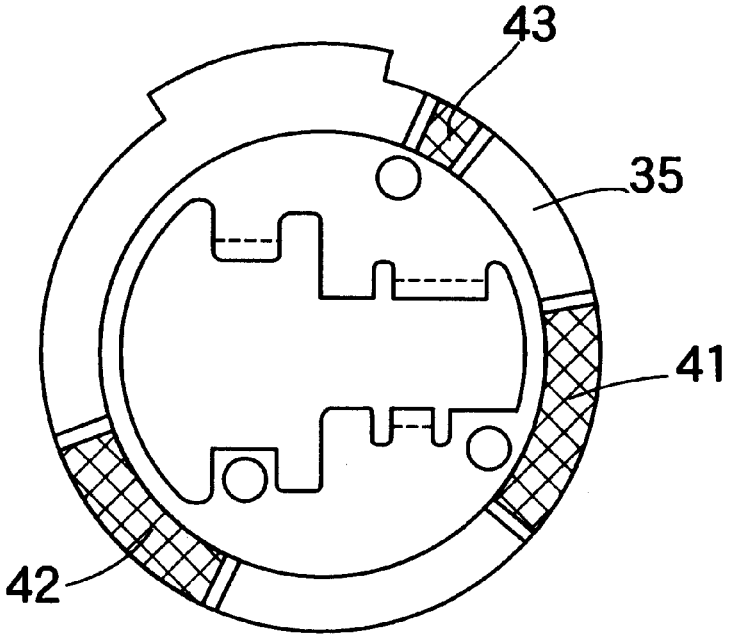

In FIG. 6, the first contact plate 35 is formed in a ring shape on a plane orthogonal to the rotation axis of the rotor 34 and a first through a third movable contact 41, 42 and 43 raised to the fixed contact assembly 27 side are integrally formed at three locations spaced from each other in the peripheral direction of the first contact plate 35 (hatched portions of FIG. 6) at the same distance from the rotation center of the rotor 34. Further, the first contact plate 35 is supported by the rotor 34 such that the position thereof in the peripheral direction relative to the rotor 34 is restricted and the movement thereof relative thereto in the axial direction is permitted in a restricted range, and springs 48, . . . for biasing the first contact plate 35 to the fixed contact assembly 27 side are provided at three locations spaced from each other in the peripheral direction between the rotor 34 and the first contact plate 35. Thereby, the first contact plate 35, namely, the first through third movable contacts 41 to 43 are floatedly supported by the rotor 34.

Figure 7:
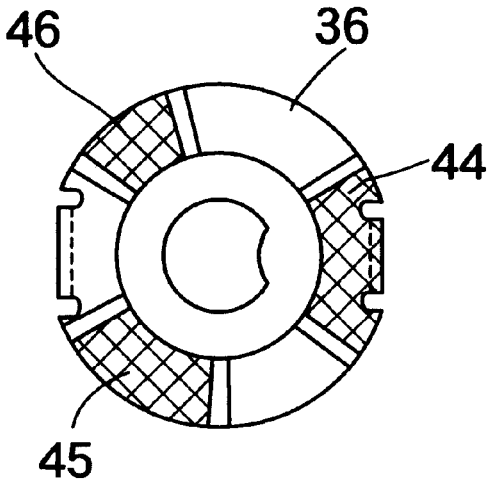
Figure 8:
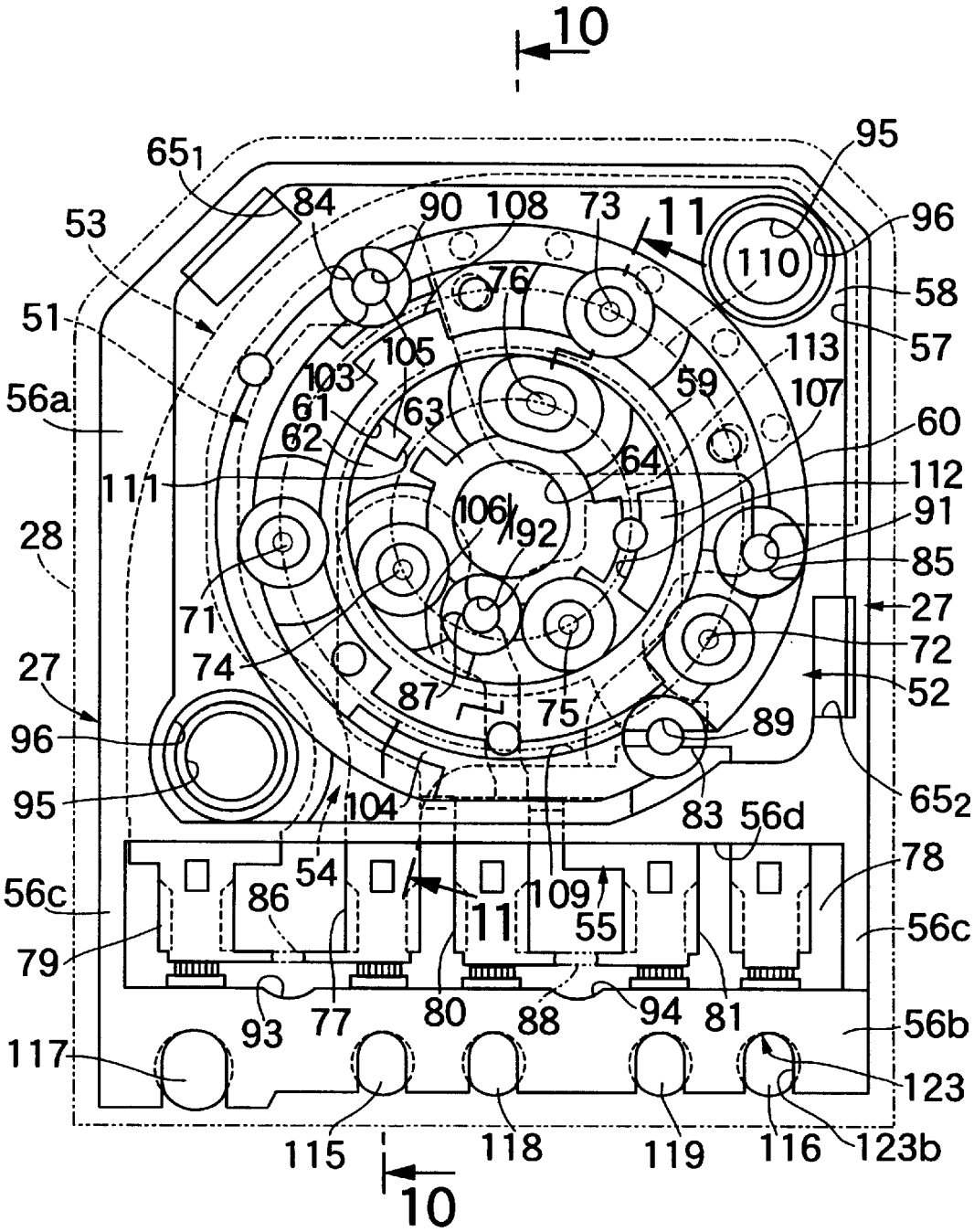
Figure 9:
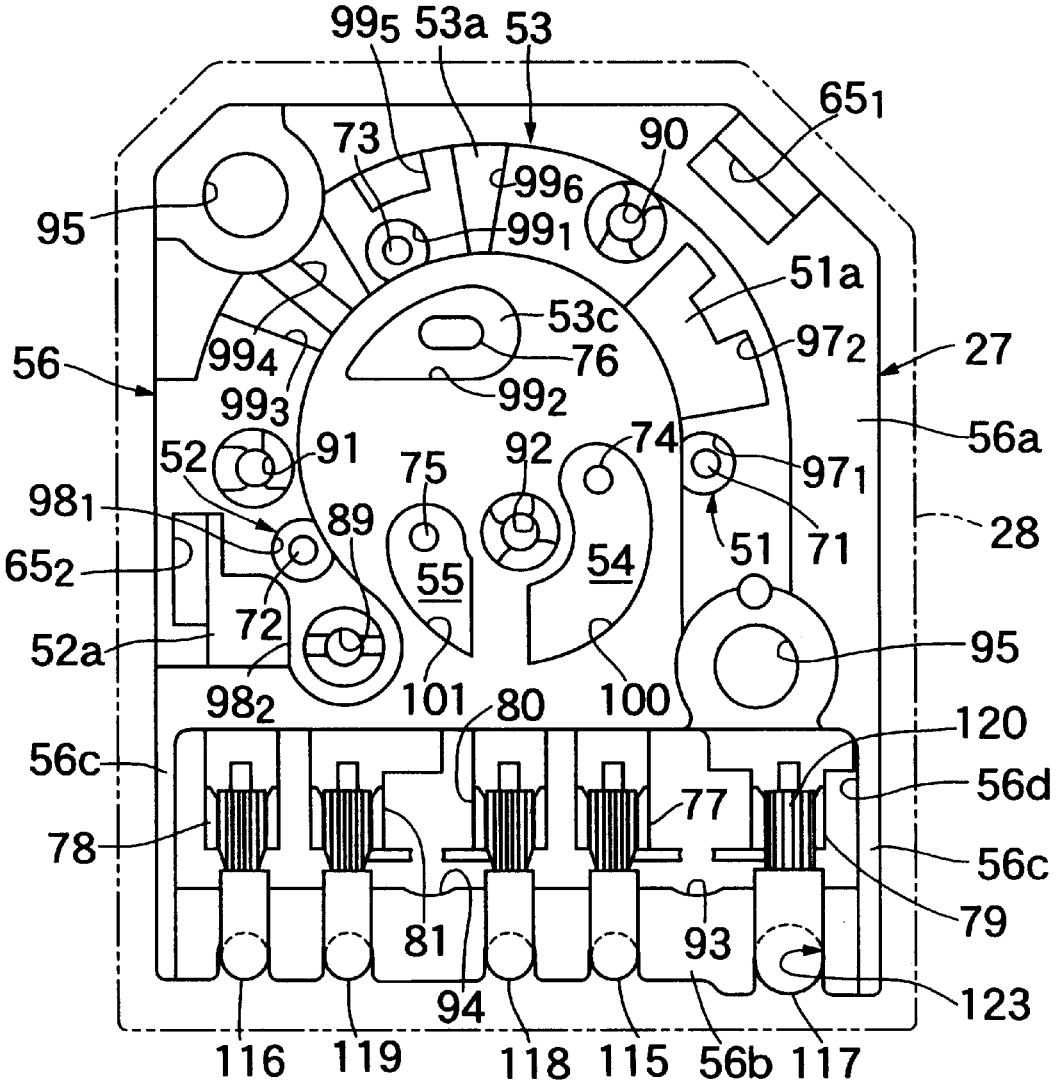
Figure 10:
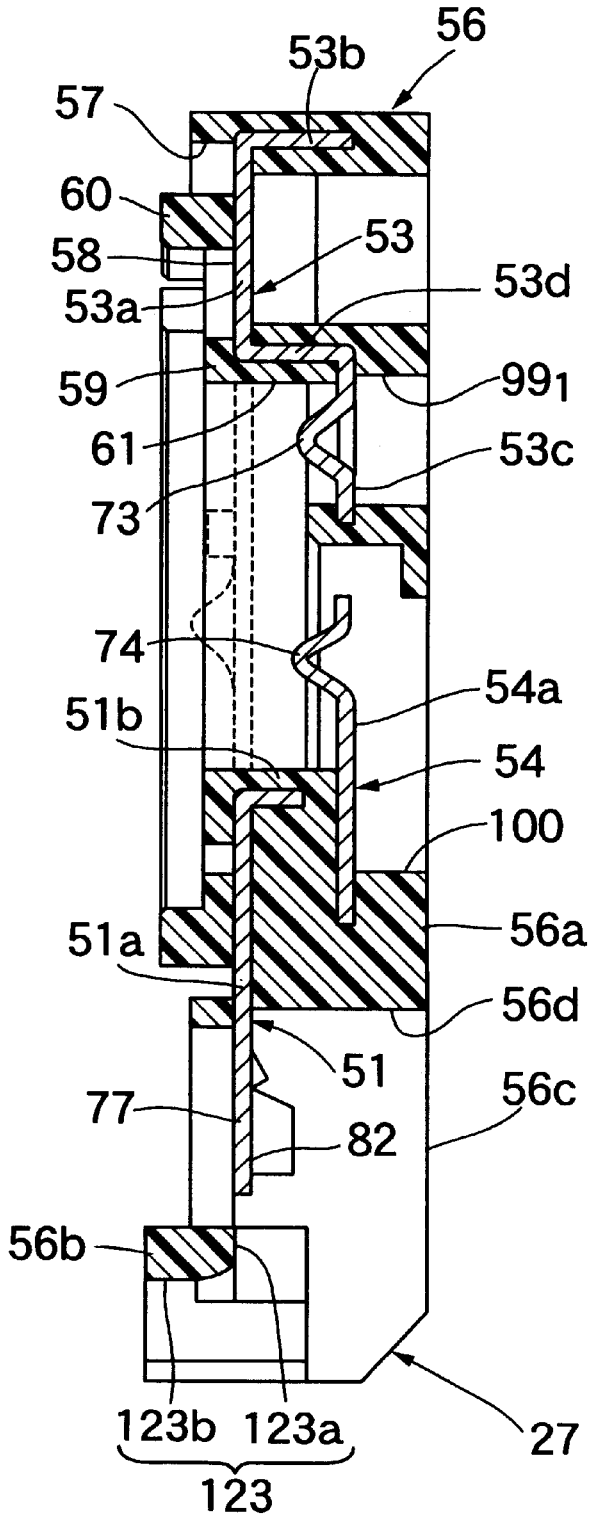
Figure 11:
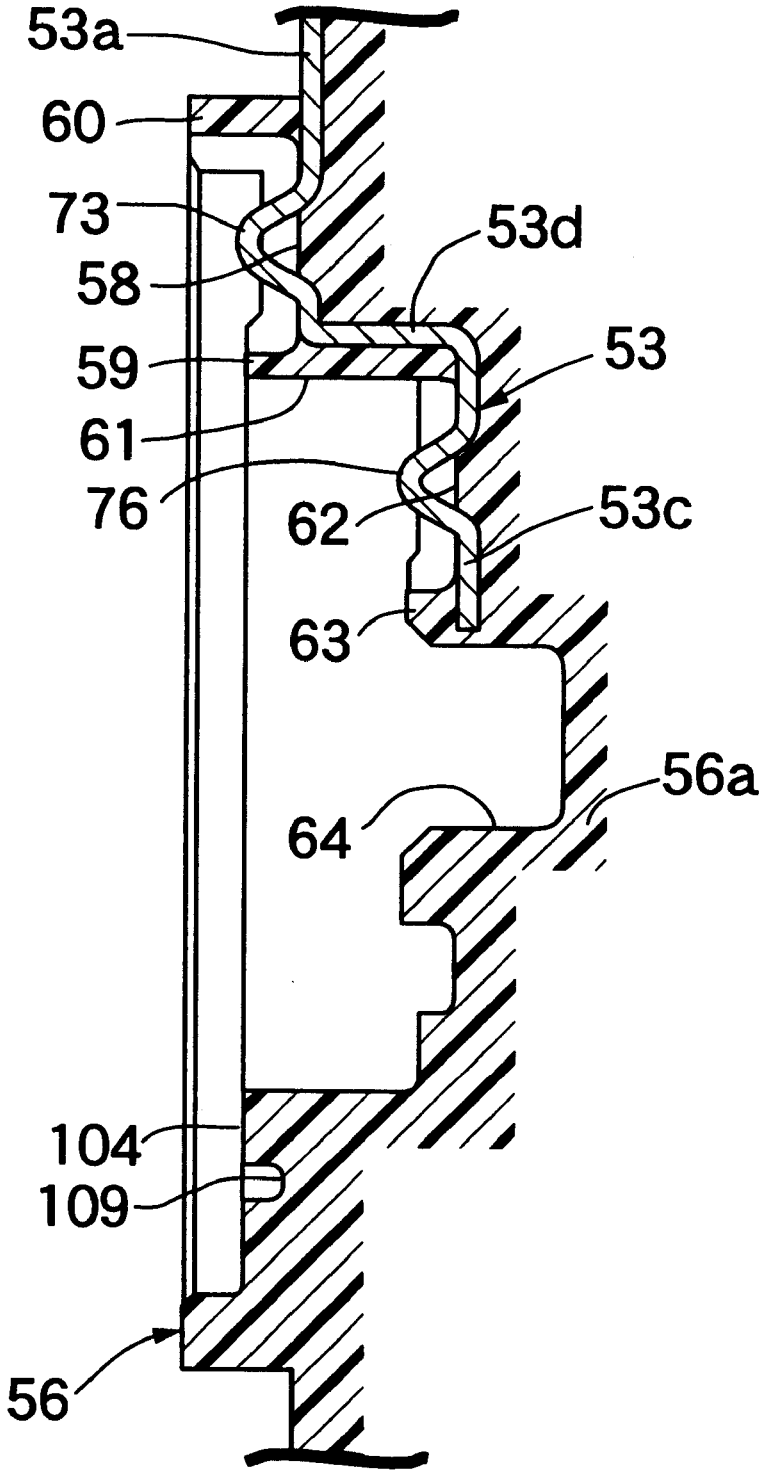

In FIG. 7, the second contact plate 36 is formed in a ring shape having a diameter smaller than that of the first contact plate 35 in a plane orthogonal to the rotation axis of the rotor 34 and fourth through sixth movable contacts 44, 45 and 46 raised to the fixed contact assembly 27 side are integrally formed at three locations of the second contact plate 36 spaced from each other in the peripheral direction (hatched portions in FIG. 7) at the same distance from the rotation center of the rotor 34. Further, the second contact plate 36 is supported by the rotor 34 at a position nearer to the fixed contact assembly 27 than the first contact plate 35 such that position thereof in the peripheral direction relative to the rotor 34 is restricted, and the movement thereof relative thereto is permitted in the axial direction in a restricted range, and springs 49, . . . for biasing the second contact plate 36 to the fixed contact assembly 27 side are provided at two locations spaced from each other in the peripheral direction between the rotor 34 and the second contact plate 36. Thereby, the second contact plate 36, namely, the fourth through sixth movable contacts 44 to 46 are floatingly supported by the rotor 34.

Further, the rotor 34 is provided integrally with a cylindrical support shaft 50 coaxial with the connecting cylinder portion 37 in such a way as to project from the fourth through sixth movable contacts 44 to 46 toward the fixed contact assembly 27 side.

In reference to FIGS. 8 to 11, the fixed contact assembly 27 is comprised of a first through a fifth bus bar 51, 52, 53, 54 and 55 made of a conductive metal which are embedded in a base member 56 made of a synthetic resin.

The base member 56 is integrally provided with a base member main portion 56*a* of a hexagonal shape approximate to a quadrangular shape, a holding portion 56*b* disposed on the base member main portion 56*a* side at an interval, and a pair of connecting portions 56*c* connecting the base member main portion 56*a* and the holding portion 56*b* to define a window 56*d* in a quadrangular shape between the base member main portion 56*a* an d the holding portion 56*b*. Thus the base member main portion 56*a* is formed to have an outer shape substantially in correspondence with the shape of the front end of the casing 22 in the cylinder lock device 21, the outer edge portion of the base member main portion 56*a* can be brought into contact with the front end portion of the casing 22 and the window 56*d* and the holding portion 56*b* are arranged to project toward side of the casing 22 in a state in which the outer edge portion of the base member main portion 56*a* is in contact with the front end portion of the casing 22.

A face of the base member main portion 56*a* facing the movable contact assembly 26 side is provided with a fitting recess portion 57 formed so that the flange portion 25*b* of the case 25 is fitted thereto, a first contact providing face 58 extended from the inner end of the fitting recess portion 57 inward along a plane orthogonal to the rotation axis of the rotary member 23, namely, the rotor 34, a first projection portion 59 in a cylindrical shape projected from the inner periphery of the first contact providing face 58 toward the rotor 34, a cylindrical fitting projection portion 60 projected from the first contact providing face 58 toward the rotor 34 between the outer periphery of the first projection portion 59 and the inner periphery of the fitting recess portion 57, a first recess portion 61 in a circular shape coaxially connected to the inner periphery of the first projection portion 59 with no step, a second contact providing face 62 in a ring shape extended from the inner end of the first recess portion 61 inward along a plane orthogonal to the rotation axis of the rotor 34, a second projection portion 63 in a cylindrical shape projected from the inner periphery of the second contact providing face 62 toward the rotor 34 and a second recess portion 64 in a circular shape coaxially connected to the inner periphery of the second projection portion 63 with no step.

The opening end of the case main portion 25*a* and the flange portion 25*b* are fitted to the fitting recess portion 57 in contact with the first contact providing face 58 outward from the fitting projection portion 57, and the fitting projection portion 60 is projected toward the case 25 from the one face of the base member main portion 56*a* to be fitted to the opening end portion of the case main portion 25*a*.

Engaging holes $\mathbf{65}_1$ and $\mathbf{65}_2$ in a quadrangular shape are disposed at a plurality of locations, for example, two locations at an interval in the circumferential direction of an outer edge portion of the first contact providing face 58 in the base member main portion 56*a*.

Figure 12:
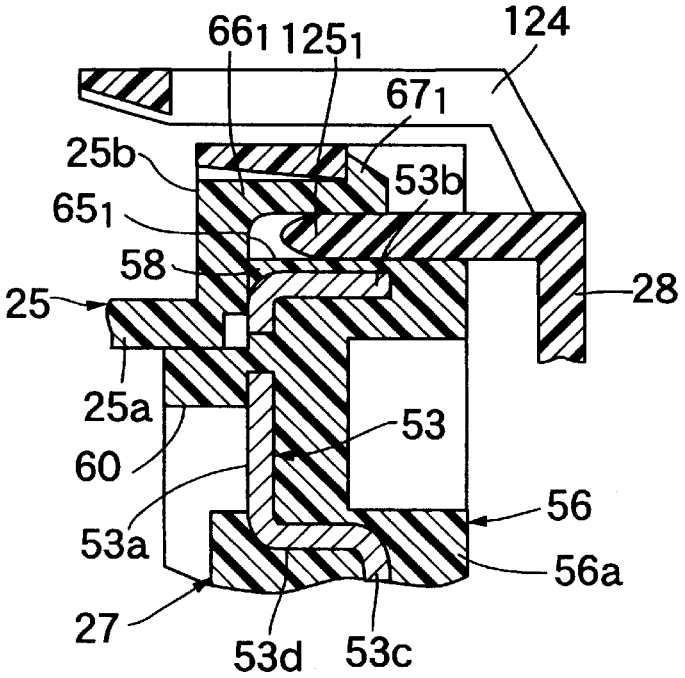
Figure 13:
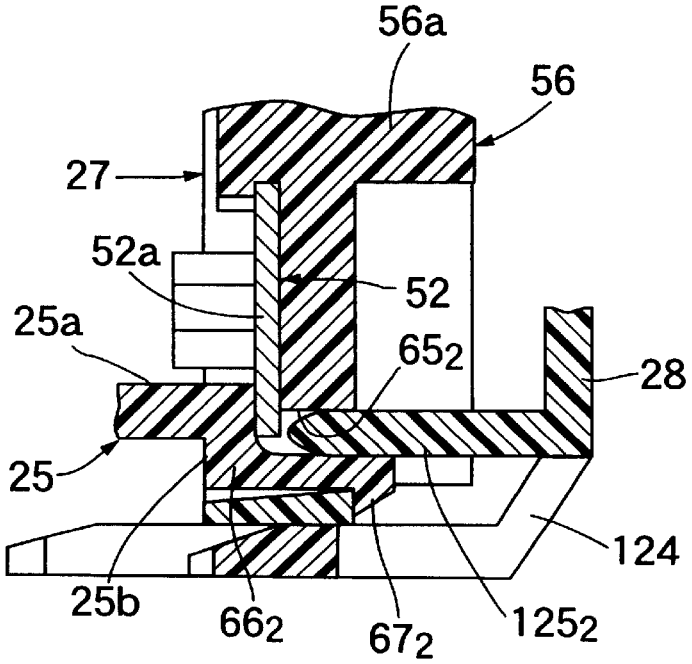

Meanwhile, as shown in FIG. 12, the flange portion 25*b* of the case 25 is integrally provided with a leg portion $\mathbf{66}_1$ having an engaging claw $\mathbf{67}_1$ engaged with other face side of the base member main portion 56*a* at its front end and inserted into the engaging hole $\mathbf{65}_1$, and as shown in FIG. 13, the flange portion 25*b* is integrally provided with a leg portion $\mathbf{66}_2$ having an engaging claw $\mathbf{67}_2$ for engaging with other face side of the base member main portion 56*a* at its front end and inserted into the other engaging hole $\mathbf{65}_2$. Further, the engaging claws $\mathbf{67}_1$ and $\mathbf{67}_2$ are projected outward from the front ends of the respective leg portions $\mathbf{66}_1$ and $\mathbf{66}_2$. Thus, by engaging the engaging claws $\mathbf{67}_1$ and $\mathbf{67}_2$ at the front ends of the leg portions $\mathbf{66}_1$ and $\mathbf{66}_2$ inserted into the respective engaging holes $\mathbf{65}_1$ and $\mathbf{65}_2$ with the other face side of the base member main portion 56*a*, the opening end of the case main portion 25*a* and the flange portion 25*b* are brought into contact with the first contact providing face 58, by which the case 25 and the base member 56 are engaged and connected with each other. In the engaged and connected state, the rotor 34 of the movable contact assembly 26 is rotatably supported between the base member main portion 56*a* and the case 25, a face of the rotor 34 is in slide contact with the front ends of the first and second support portions 31 and 32 of the case 25 and thrust supported thereby, and the front end of the support shaft 50 provided to the other face side of the rotor 34 is in slide contact with a closed end of the second recess portion 64 of the base member main portion 56*a* and is thrust supported thereby.

Figure 14:
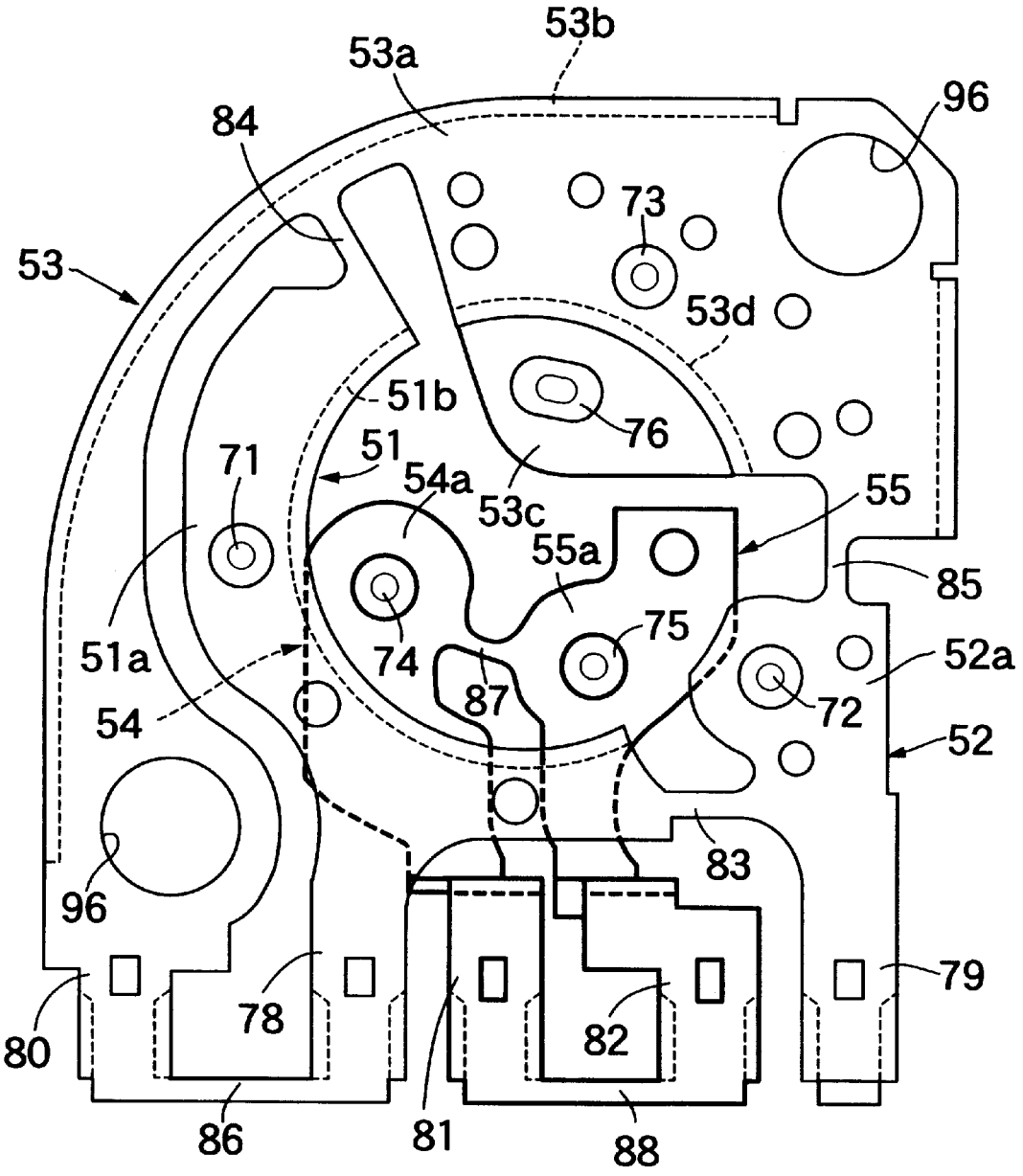
Figure 15:
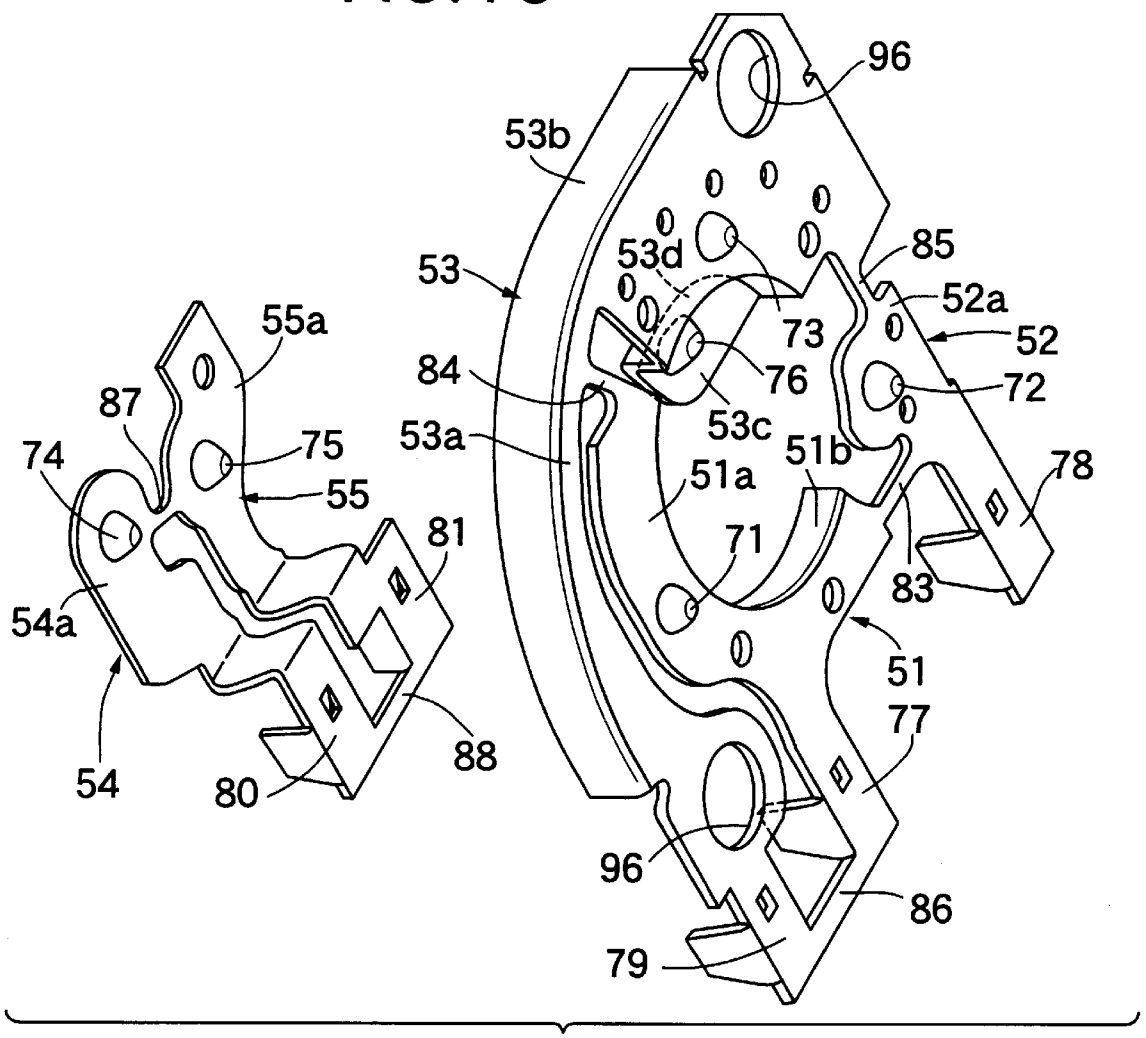

In FIGS. 14 and 15, the first bus bar 51 is integrally provided with a flat plate portion 51*a* in a circular arc shape in flush with the first contact providing face 58 and a side plate portion 51*b* orthogonally connected to the inner periphery of the flat plate portion 51*a,* which is embedded in the base member main portion 56*a,* the second bus bar 52 is provided with a flat plate portion 52*a* in flush with the first contact provided face 58 which is embedded in the base member main portion 56*a,* and the third bus bar 53 is integrally provided with a first plate portion 53*a* in a circular arc shape in flush with the first contact providing face 58, a first side plate portion 53*b* orthogonally connected to the outer periphery of the flat plate portion 53*a,* a second plate portion 53*c* in flush with the second contact providing face 62, and a second side plate portion 53*d* orthogonally connected to the inner periphery of the first flat plate portion 53*a* and the outer periphery of the second flat plate portion 53*c,* which is embedded in the base member main portion 56*a.*

A first fixed contact 71 is integrally provided with the flat plate portion 51*a* of the first bus bar 51 in such a way as to project toward the rotor 34, a second fixed contact 72 is provided integrally with the flat plate portion 52*a* of the second bus bar 52 in such a way as to project toward the rotor 34, and a third fixed contact 73 is provided integrally with the first flat plate portion 53*a* of the third bus bar 53 in such a way as to project toward the rotor 34. Further, the flat plate portions 51*a* and 52*a,* and the first flat plate portion 53*a* are provided and arranged around the first recess portion 61 in such a way as to have areas as wide as possible in the first contact providing face 58, and the first through third fixed contacts 71 to 73 are integrally provided with the flat plate portions 51*a* and 52*a,* and the first flat plate portion 53*a* in such a way that they are spaced from each other at intervals in the peripheral direction at the same distance from the rotation center of the rotor 34 to perform connection/disconnection to/from the first through third movable contacts 41 through 43 of the rotor 34.

The fourth bus bar 54 is provided with a flat plate portion 54*a* in flush with the second contact providing face 62, which is embedded in the base member main portion 56*a,* and the fifth bus bar 55 is provided with a flat plate portion 55*a* in flush with the second contact providing face 62, which is embedded in the base member main portion 56*a.*

A fourth fixed contact 74 is integrally provided with the flat plate portion 54*a* of the fourth bus bar 54 to project toward the rotor 34, a fifth fixed contact 75 is integrally provided with the flat plate portion 55*a* of the fifth bus bar 55 to project toward the rotor 34, and a sixth fixed contact 76 is provided integrally with the second flat plate portion 53*c* of the third bus bar 53 to project toward the rotor 34. Further, the flat plate portions 54*a* and 55*a,* and the second flat plate portion 53*c* are provided and arranged around the second recess portion 63 in such a way as to have areas as wide as possible in the second contact providing face 52, and the fourth through sixth fixed contacts 74 to 76 are integrally provided with the flat plate portions 54*a* and 55*a,* and the second flat plate portion 53*c* in such a way that they are spaced from each other at intervals in the peripheral direction at the same distance from the rotation center of the rotor 34 to perform connection/disconnection to/from the fourth through sixth movable contacts 44 to 46 of the rotor 34.

Figure 16:
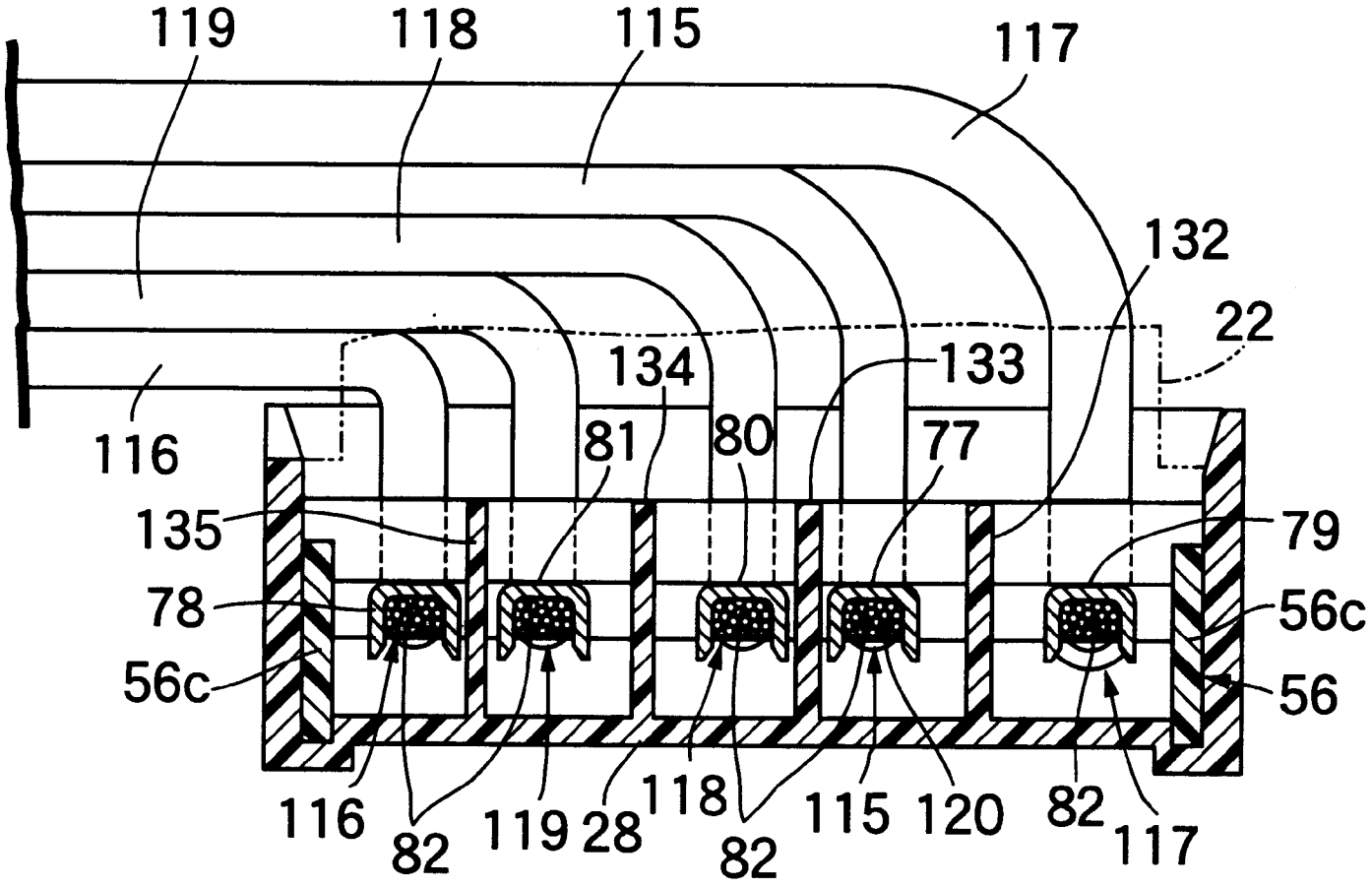

As is shown in FIG. 16, the bus bars 51 to 55 are integrally provided with terminal portions 77, 78, 79, 80 and 81 respectively, arranged in parallel at the window 56*d* of the base member 56 in a state where they are embedded in the base member main portion 56*a* of the base member 56, and the terminal portions 77 to 81 are respectively provided with bonding faces 82, . . . facing the other face side of the base member 56, namely, the opposite side to the casing 22, and are formed in a generally U-shape.

Meanwhile, the first through third bus bars 51, 52 and 53, and the fourth and fifth bus bars 54 and 55 are integrated in a state in which they are inserted into a die for molding the base member 56 to embed them into the base member 56. That is, the flat plate portion 51*a* of the first bus bar 51 and the flat plate portion 52*a* of the second bus bar 52 are connected with a connecting portion 83, the flat plate portion 51*a* of the first bus bar 51 and the first flat plate portion 53*a* of the third bus bar 53 are connected by a connecting portion 84, the first flat plate portion 53*a* of the third bus bar 53 and the flat plate portion 52*a* of the second bus bar 52 are connected with a connecting portion 85, and the terminal portions 77 and 78 of the first and the third bus bars 51 and 53 are connected with a connecting portion 86, by which the first through third bus bars 51, 52 and 53 are integrated. Further, the flat plate portions 54*a* and 55*a* of the fourth and fifth bus bars 54 and 55 are connected with a connecting portion 87 and the terminal portions 80 and 81 of the fourth and the fifth bus bars 54 and 55 are connected by a connecting portion 88, by which the fourth and fifth bus bars 54 and 55 are integrated.

By integrating the first through third bus bars 51 to 53 and integrating the fourth and fourth bus bars 54 and 55 in such a way, the positioning and arrangement of the bus bars 51 to 55 into the die is facilitated and simplification of the constitution of the die can be achieved.

The connecting portions 83 to 88 are punched after the molding of the base member 56. That is, immediately after molding the base member 56 by mold-connecting the bus bars 51 to 55, on both faces of the base member main portion 56*a* of the base member 56, recess portions for allowing both faces of the connecting portions 83, 84, 85 and 87 to face to the outside are formed, part of the connecting portions 83, 84, 85 and 87 are punched at portions thereof facing to the recess portions to form through holes 89, 90, 91 and 92, and thereby the connecting portions 83 to 85 and 87 are cut. Further, in the holding portion 56*b* of the base member 56, punch escapements 93 and 94 are formed in the shape of an arcuate groove immediately after the molding, and by carrying out punching in correspondence with the punch escapements 93 and 94, the connecting portions 86 and 88 are cut. Further, by punching the connecting portions 83 to 88 after molding the base member 56, the bus bars 51 to 55 are arranged in the base member 56 in a state where they are electrically isolated from each other.

Further, in the base member main portion 56*a,* insertion holes 95 are provided at positions in correspondence with a pair of insertion holes 33, disposed in the flange portion 25*b* of the case 25, and insertion holes 96 in correspondence with the insertion holes 95 are provided at the first flat plate portion 53*a* of the third bus bar 53.

Further, on the other face side of the base member main portion 56*a,* namely, on the opposite face thereof to the rotor 34, there are provided an opening portion $\mathbf{97}_1$ for exposing the flat plate portion 51*a* of the first bus bar 51 to the outside around the first fixed contact 71, an opening portion $\mathbf{97}_2$ for exposing the flat plate portion 51*a* of the first bus bar 51 at a position away from the first fixed contact 71, an opening portion $98_1$ for exposing the flat plate portion 52*a* of the second bus bar 52 to the outside around the second fixed contact 72, an opening portion $98_2$ for exposing the flat plate portion 52*a* of the second bus bar 52 at a position away from the second fixed contact 72, an opening portion $99_1$ for exposing the first flat plate portion 53*a* of the third bus bar 53 to the outside around the third fixed contact 73, an opening portion $99_2$ for exposing the second flat plate portion 53*c* of the third bus bar 53 to the outside around the sixth fixed contact 76, opening portions $99_3$, $99_4$, $99_5$ and $99_6$ for exposing the first flat plate portion 53*a* of the third bus bar 53 to the outside at a plurality of locations, for example, four locations away from the third fixed contact 73, an opening portion 100 for exposing the flat plate portion 54*a* of the fourth bus bar 54 to the outside around the fourth fixed contact 74, and an opening portion 101 for exposing the flat plate portion 55*a* of the fifth bus bar 55 to the outside around the fifth fixed contact 75.

Figure 17:
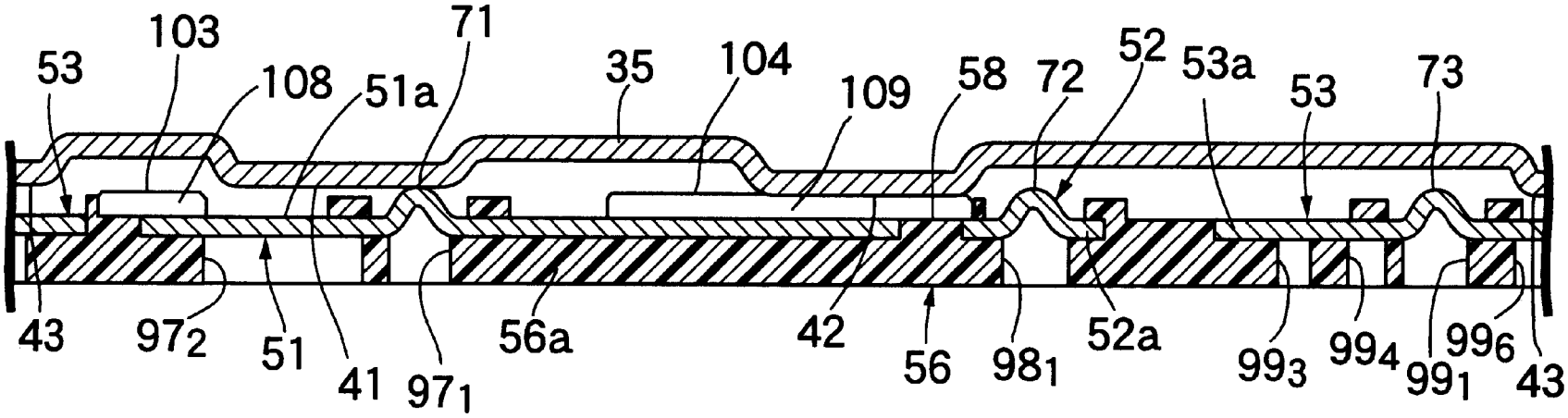
Figure 18:
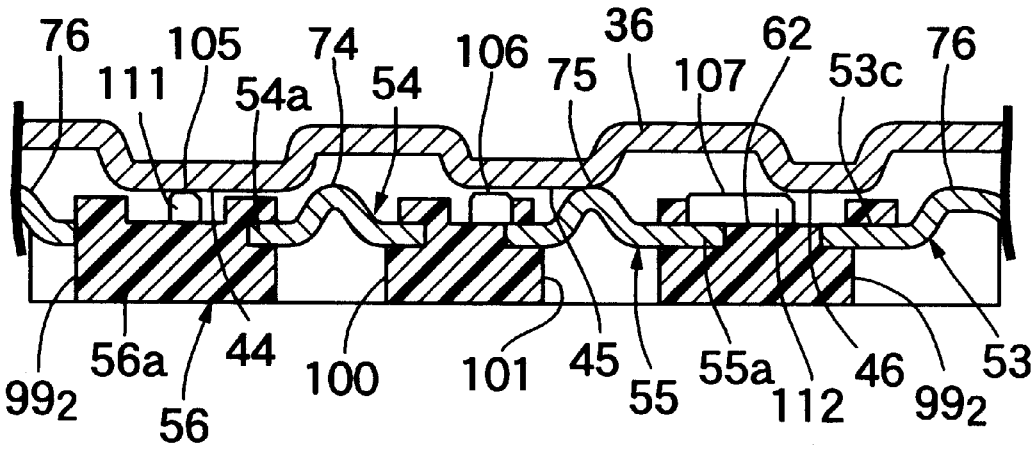

Meanwhile, when the rotary member 23 of the cylinder lock device 21 is at the LOCK position, the relative arrangement in the peripheral direction of the first through third movable contacts 41 through 43 and the first through third fixed contacts 71 to 73 is shown in FIG. 17 and the relative arrangement in the peripheral direction of the fourth through sixth movable contacts 41 to 46 and the fourth through sixth fixed contacts 74 to 76 is shown in FIG. 18, in accordance with the rotation of the rotary member 23 from the LOCK position to the ACC position, the first through sixth movable contacts 41 to 46 are disposed at positions displaced from the positions of FIG. 17 and FIG. 18 to the left side by 55 degrees, in accordance with the rotation of the rotary member 23 from the ACC position to the ON position, the first through sixth movable contacts 41 to 46 are disposed at positions displaced from the positions of FIG. 17 and FIG. 18 to the left side by 90 degrees. Further, in accordance with the rotation of the rotary member 23 from the ON position to the START position, the first through sixth movable contacts 41 to 46 are disposed at positions displaced from the positions of FIG. 17 and FIG. 18 to the left side by 125 degrees.

In accordance with the angular displacement of the movable contacts 41 to 46 as mentioned above, the connected/disconnected states of the first through third movable contacts 41 to 43 to/from the first through third fixed contacts 71 to 73 are changed, and the connected/disconnected states of the fourth through sixth movable contacts 44 to 46 to/from the fourth through sixth fixed contacts 74 to 76 are changed. Since the first contact plate 35 in a ring shape integrally formed with the first through third movable contacts 41 through 43 and the second contact plate 36 in a ring shape integrally formed with the fourth through sixth movable contacts 44 to 46, are biased by the spring toward the base member 56 and are floatedly supported by the rotor 34, in a state in which one of the first through third movable contacts 41 to 43 is in contact with one of the first through third fixed contacts 71 to 73, and in a state in which one of the fourth through the sixth movable contacts 44 to 46 is in contact with one of the fourth through the sixth fixed contacts 74 to 76, each of the first and second contact plates 35 and 36 is supported by one point in the peripheral direction and therefore, the contact state is liable to be unstable.

Hence, in order to bring at least two of the first through third movable contacts 41 to 43 provided on the first contact plate 35 into contact with two locations in the peripheral direction of the fixed contact assembly 27, the base member main portion 56*a* is formed with a first sliding face 103 between the first and the third fixed contacts 71 and 73 in flush with the first projection portion 59, and formed with a second sliding face 104 between the second fixed contact 72 and the first fixed contact 71 in flush with the first projection portion 59. Further, in order to bring at least two of the fourth through sixth movable contacts 44 to 46 provided on the second contact plate 36 into contact with two locations in the peripheral direction of the fixed contact assembly 27, the base member main portion 56*a* is formed with a third sliding face 105 between the sixth and the fourth fixed contacts 76 and 74 in flush with the second projection portion 63, formed with a fourth sliding face 106 between the fourth and the fifth fixed contacts 74 and 75 in flush with the second projection portion 63, and formed with a fifth sliding face 107 between the fifth and the sixth fixed contacts 75 and 76 in flush with the second projection portion 63.

Thus, the first through third fixed contacts 71 to 73 are projected from the first and second sliding faces 103 and 104 toward the rotor 34, and the fourth through sixth fixed contacts 74 to 76 are projected from the third through fifth sliding faces 105 to 107 toward the rotor 34.

Further, the first and second sliding faces 103 and 104 are provided with grooves 108 and 109 in an arcuate shape along the loci 110 (see FIG. 8) which are drawn by the portions or ranges of the first through third movable contacts 41 to 43 to be brought into slide contact with the fixed contacts 71 to 73 in accordance with the rotation of the rotor 34 and the third through fifth sliding faces 105 to 107 are provided with grooves 111 and 112 in an arcuate shape along the loci 113 (see FIG. 8) which are drawn by the ranges of the fourth through sixth movable contacts 44 to 46 to be brought into slide contact with the fixed contacts 74 to 76 in accordance with the rotation of the rotor 34. Further, the base member 56 is provided with a recess portion in correspondence with the through hole 92 inside the fourth slide face 106, by which the sliding face 106 is disposed outside the loci 113 which are drawn by the ranges of the fourth through sixth movable contacts 44 to 46 to be brought into slide contact with the fixed contacts 74 to 76 incident to the rotation of the rotor 34. That is, the first and second sliding faces 103 and 104 are formed in the base member main portion 56*a* to avoid the loci 110 which are drawn by the ranges of the first through third movable contacts 41 to 43 to be brought into slide contact with the fixed contacts 71 to 73 in accordance with the rotation of the rotor 34, and the third through fifth sliding faces 103 to 105 are formed in the base member main portion 56*a* to avoid the loci 113 which are drawn by the ranges of the fourth through sixth movable contacts 44 to 46 to be brought into slide contact with the fixed contacts 74 to 76 in accordance with the rotation of the rotor 34.

Figure 19:
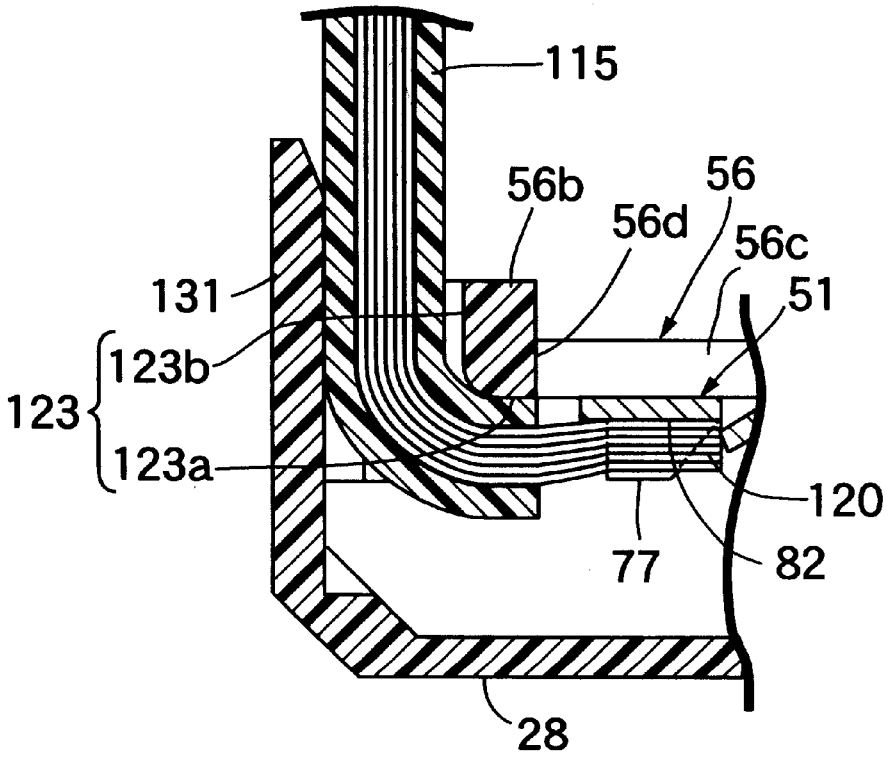

Lead wires 115, 116, 117, 118 and 119 are respectively connected to the terminal portions 77 to 81 arranged in parallel with each other at the window 56*d* of the base member 56. The terminal portions 77 to 81 are formed of a generally U-shape to respectively constitute the bonding faces 82, . . . facing the opposite side to the casing 22, and as shown in FIG. 19, conductors 120, . . . of the lead wires 115 to 119 are fitted to the respective terminal portions 77 to 81 and directly bonded to the bond faces 82.

Figure 20C:
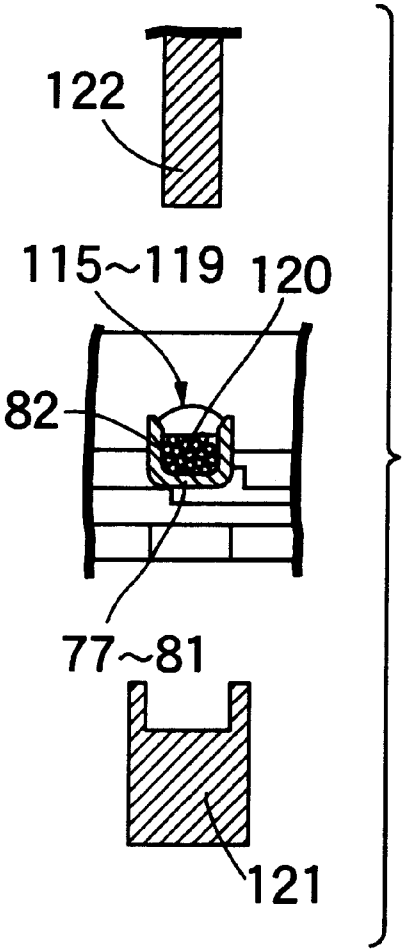
FIGS. 20A–20C are sectional views successively showing the procedure of bonding a lead wire to a terminal portion.
Figure 20B:
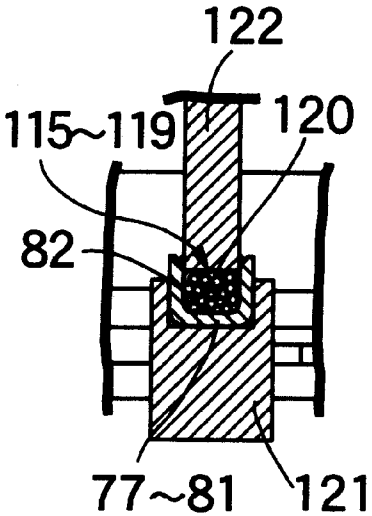
Figure 20A:
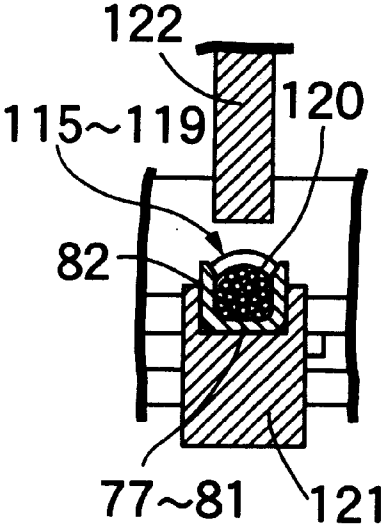

Thus, in bonding the conductors 120, . . . of the lead wires 115 to 119 to the respective terminal portions 77 to 81, as shown in FIGS. 20A–20C, there are used first electrodes 121 fitted to the opposite side to the bonding faces 82, . . . of the terminal portions 77 to 81 and serving to receive the respective terminal portions 77 to 81, and second planar electrodes 122 capable of sandwiching the conductors 120, . . . between the respective bonding faces 82, . . . and the second electrodes 122. Three steps are carried out: a step of receiving the terminal portions 77 through 81 by the first electrodes 121 in a state in which the conductors 120, . . . of the lead wires 115 to 119 are fitted to the respective terminal portions 77 to 81 as shown in FIG. 20A, and a step of bonding the conductors 120, . . . to the respective terminal portions by thermocompression bonding by operating the second electrodes 122 in such a way that the respective conductors 120, . . . are pinched between the bonding faces 82, . . . and the second electrodes 122 as shown in FIG. 20B, and a step of moving the first and second electrodes 121 and 122 away from the terminal portions 77 to 81 as shown in FIG. 20C.

In this way, the lead wires 115 to 119 bonded to the terminal portions 77 to 81 are held by the holding portion 56*b* of the base member 56.

The holding portion 56*b* is provided with fitting grooves 123, . . . in correspondence with the respective lead wires 115 to 119, the fitting grooves 123, . . . each comprises a first groove portion 123*a* opened to the opposite side to the casing 22, namely, toward the cover 28 and a second groove portion 123*b* opened to the outside of the base member 56 and connected to the first groove portion 123*a*, forming a generally L-shape. The lead wires 115 to 119 are held by the holding portion 56*b* in a direction where an angle relative to the respective bonding faces 82, . . . is formed in a plane orthogonal to the direction of the array of the terminal portions 77 to 81 by being respectively fitted to the fitting grooves 123, . . .

The cover 28 is formed in a box shape made of a synthetic resin to cover the entire fixed contact assembly 27, that is, the entire base member 56 including portions for connecting the lead wires 115 to 119 to the respective terminal portions 77 to 81 from the opposite side to the casing 22. Further, a plurality of heat radiating openings 124, . . . are provided in the side of the cover 28 to prevent heat from being accumulated between the fixed contact assembly 27 and the cover 28.

The cover 28 is integrally provided with a pair of come-off preventive portions $\mathbf{125}_1$ and $\mathbf{125}_2$ in correspondence with the engaging holes $\mathbf{65}_1$ and $\mathbf{65}_2$ disposed in the base member main portion 56*a* to project toward the base member 56, and the come-off preventive portions $\mathbf{125}_1$ and $\mathbf{125}_2$ are fitted to the respective engaging holes $\mathbf{65}_1$ and $\mathbf{65}_2$ in such a way as to interpose between the base member 56 and the respective leg portions $\mathbf{66}_1$ and $\mathbf{66}_2$. Further, by fitting the come-off preventive portions $\mathbf{125}_1$ and $\mathbf{125}_2$, the cover 28 is connected to the base member 56.

In order to prevent dust and the like from entering, through the through holes 89 to 92 disposed in the base member 56, the space between the movable contact assembly 26 and the fixed contact assembly 27, the cover 28 is integrally provided with bosses 126, 127, 128 and 129 for closing the through holes 89 to 92 by their front ends, and the bosses 126 to 129 are cylindrically formed, having closed front ends to achieve a lightweight structure.

The cover 28 is integrally provided with a restraining wall 131 disposed outside the holding portion 56*b* of the base member 56, and the restraining wall 131 serves to restrain the lead wires 115 to 119 between the restraining wall 131 and the second groove portions 113*b* of the fitting grooves 123, . . . disposed in the holding portion 56*b* so as to individually fit the lead wires 115 to 119.

Further, as shown in FIG. 16, the cover 28 is integrally provided with a partition wall 132 for partitioning the area between the portion for connecting the conductor 120 of the lead wire 115 to the terminal portion 77 of the wire 117 and the portion for connecting the conductor 120 of the lead wire 117 to the terminal portion 79, a partitioning wall 133 for partitioning the area between the portion for connecting the conductor 120 of the lead wire 115 to the terminal portion 77 and the portion for connecting the conductor 120 of the lead wire 118 to the terminal portion 80, a partitioning wall 134 for partitioning the area between the portion for connecting the conductor 120 of the lead wire 118 to the terminal portion 80 and the portion for connecting the conductor 120 of the lead wire 119 to the terminal portion 81, and a partitioning wall 135 for partitioning the area between the portion for connecting the conductor 120 of the lead wire 116 to the terminal portion 78 and the portion for connecting the conductor 120 of the lead wire 119 to the terminal portion 81.

Figure 3:
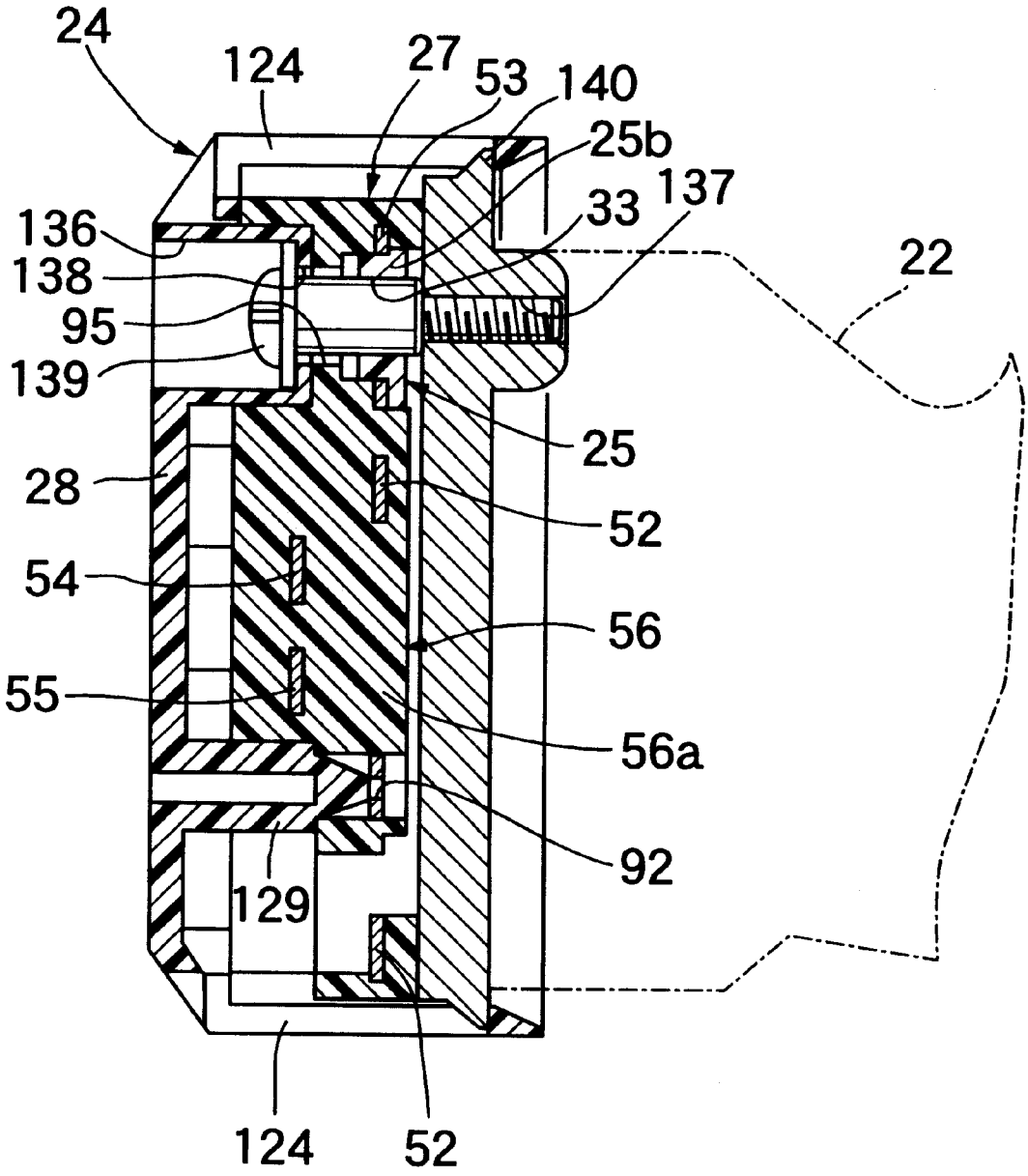
Figure 4:
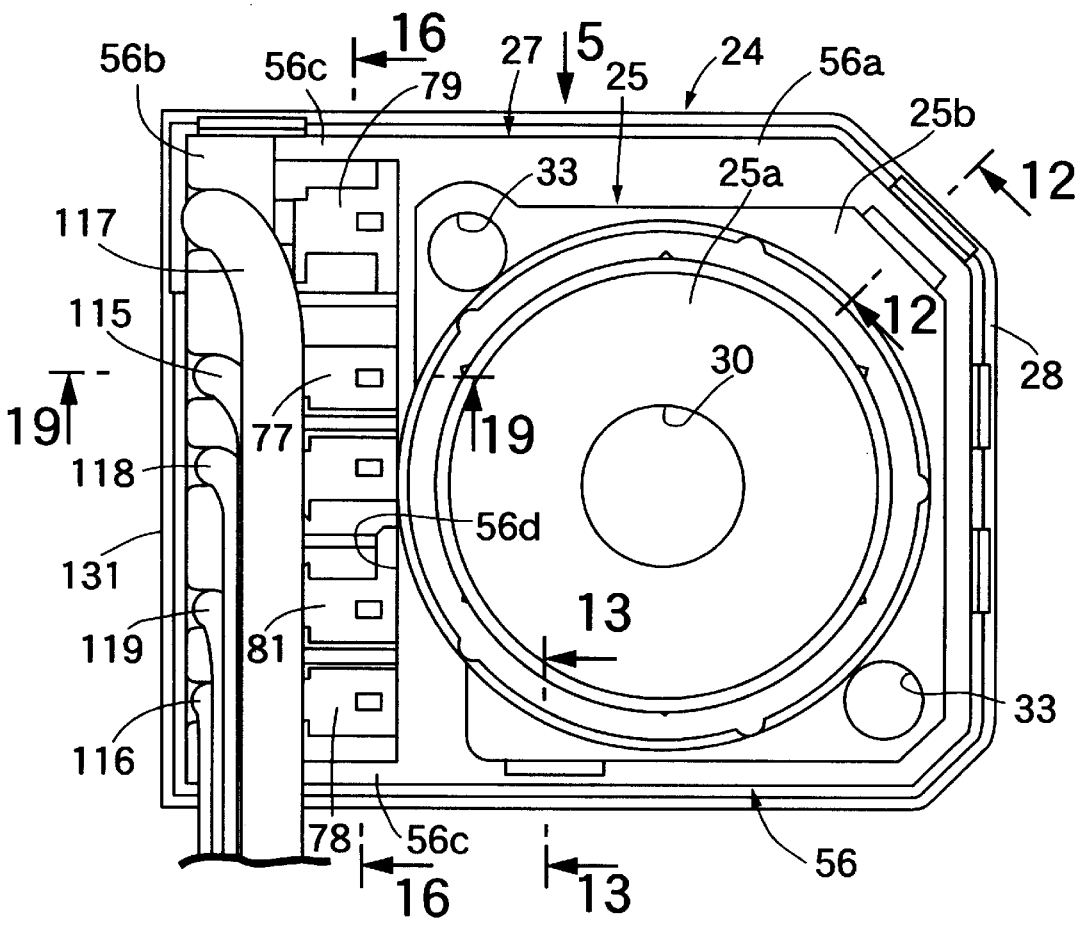
Figure 5:
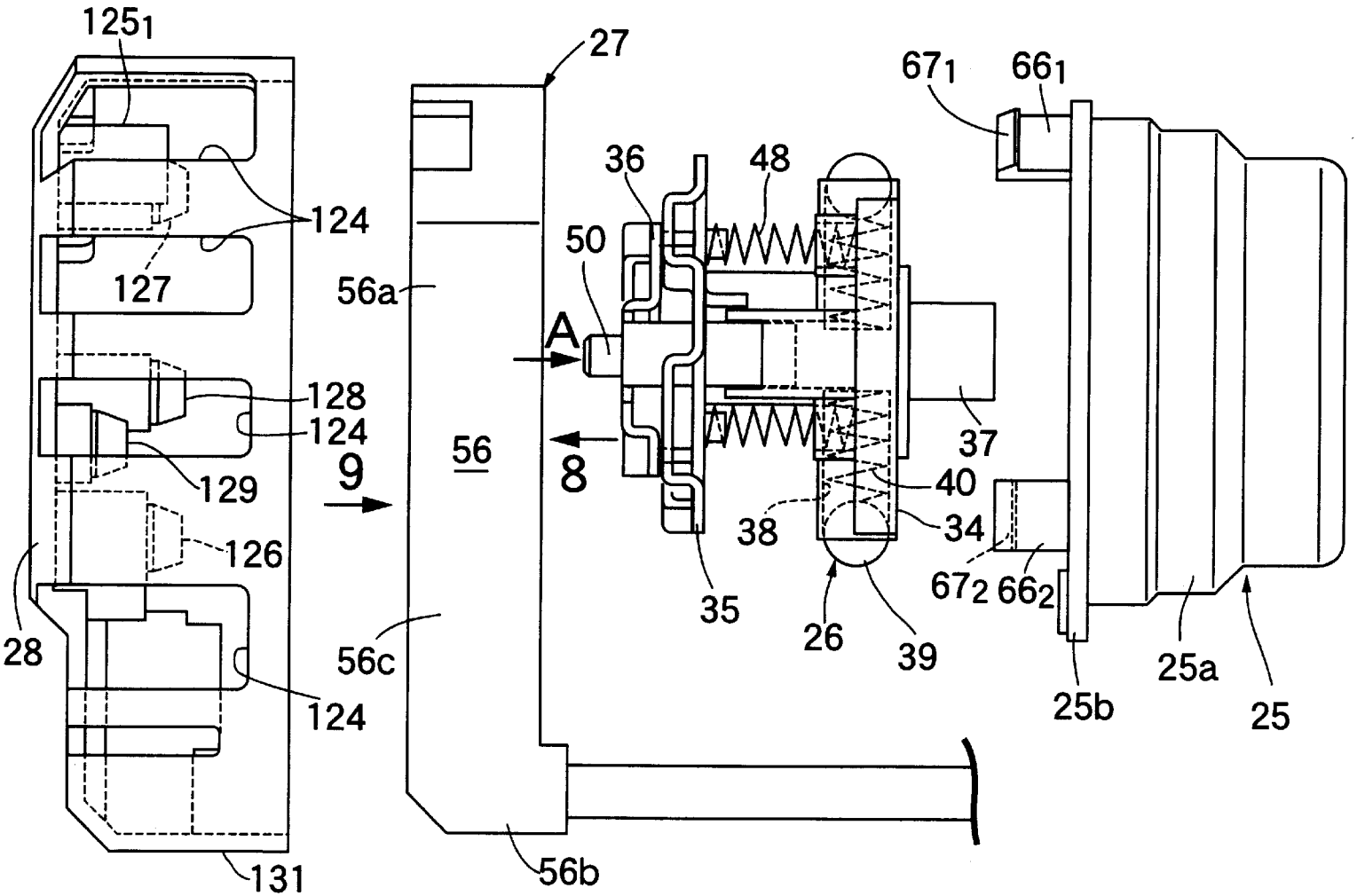

Further, as shown in FIG. 3, the cover 28 is provided with recess portions 136, . . . recessed toward the base member 56 at positions in correspondence with the insertion holes 95, . . . of the base member 56, and the front end portion of the casing 22 of the cylinder lock device 21 is provided with screw holes 137, . . . coaxially in correspondence with the insertion holes 95, . . . of the base member 56 and the insertion holes 33, . . . of the case 25. Further, insertion holes 138, . . . coaxially connected to the insertion holes 95, . . . are provided in the closed ends of the recess portions 136, . . . and screw members 139, . . . inserted into the insertion holes 138, . . . , 95, . . . , and 136, . . . are screwed to the screw holes 137, . . . , and the ignition switch 24 is attached to the casing 22 by fastening the screw members 139, . . .

Meanwhile, on the outer peripheral portion of the front end portion of the casing 22, portions thereof in correspondence with a plurality of the heat radiating ports 124, . . . of the cover 28, for example, two of the heat radiating openings 124, are integrally provided with claws 140 for engaging with the end portions of the heat radiating openings 124 on the casing 22 side in such a way as to project outward, and the ignition switch 24 can be provisionally attached to the casing 22 by engaging the claws 140 to the end portions of the heat dissipating openings 124 on the casing 22 side before attaching the ignition switch 24 to the casing 22.

Next, describing the operation of the embodiment, the ignition switch 24 is provided with the case 25, the movable contact assembly 26 comprised of the plurality of movable contacts 41 to 46 being floatingly supported by the rotor 34, the fixed contact assembly 27 comprised of the plurality of fixed contacts 71 to 76 to be fixed to the base member 56, and the cover 28 connected to the base member 56 to cover the other face side of the base member 56. The cover 28 covers the portions for connecting the fixed contacts 71 to 76 to the lead wires 115 to 119, and accordingly, the insulation reliability of the connecting portions can be enhanced.

Further, the plurality of leg portions $\mathbf{125}_1$ and $\mathbf{125}_2$ integrally provided to the case 25 are inserted into the engaging holes $\mathbf{65}_1$ and $\mathbf{65}_2$ provided to the base member 56, and the engaging claws $\mathbf{67}_1$ and $\mathbf{67}_2$ integrally provided to the front ends of the respective leg portions $\mathbf{66}_1$ and $\mathbf{66}_2$ are engaged with the other face side of the base member 56, by which the base member 56 and the case 25 are engaged and connected with each other. Since the engaging claws $\mathbf{67}_1$ and $\mathbf{67}_2$ are integrally provided to the front ends of the leg portions $\mathbf{66}_1$ and $\mathbf{66}_2$ in such a way as to project from the front ends of the respective leg portions $\mathbf{66}_1$ and $\mathbf{66}_2$ outward, a die apparatus for molding the case 25 does not need any slide die which has conventionally been needed, and simplification of the die structure can be achieved.

Further, the cover 28 is integrally provided with the come-off preventive portions $\mathbf{125}_1$ and $\mathbf{125}_2$ fitted to the engaging holes $\mathbf{65}_1$ and $\mathbf{65}_2$ by being interposed between the leg portions $\mathbf{66}_1$ and $\mathbf{66}_2$ inserted into the respective engaging holes $\mathbf{65}_1$ and $\mathbf{65}_2$ and the base member 56, and therefore, even when the numbers of the engaging holes $\mathbf{65}_1$ and $\mathbf{65}_2$, the leg portions $\mathbf{66}_1$ and $\mathbf{66}_2$ and the engaging claws $\mathbf{67}_1$ and $\mathbf{67}_2$ are comparatively decreased, there can be eliminate the possibility of releasing the engagement between the engaging claws $\mathbf{67}_1$ and $\mathbf{67}_2$ and the base member 56 even by stress relaxation at high temperature, and the assembly workability can be enhanced by facilitating the assembly of the case 25 to the base member 56.

In order to stably bring the movable contacts 41 to 43 and 44 to 46 integrally provided to the first and second contact plates 35 and 36 which are floatingly supported by the rotor 34, into contact with the fixed contacts 71 to 76 which are fixed to the base member 56, the base member 56 is provided with the first and second sliding faces 103 and 104 in correspondence with the first contact plate 35, and the third through fifth sliding faces 105 to 107 in correspondence with the second contact plate 36 along the planes orthogonal to the rotation axis of the rotor 34. The first and second sliding faces 103 and 104 are formed in the base member 56 to avoid the loci 110 which are drawn by the ranges of the first and third movable contacts 41 and 43 to be brought into slide contact with the fixed contacts 71 to 73 in accordance with the rotation of the rotor 34. The third through fifth sliding faces 105 to 107 are formed in the base member 56 to avoid the loci 113 which are drawn by the ranges of the third through sixth movable contacts 44 to 46 to be brought into slide contact with the fixed contacts 74 to 76 in accordance with the rotation of the rotor 34.

Therefore, the ranges of the first and third movable contacts 41 and 43 to be brought into slide contact with the fixed contacts 71 to 73 are not brought into slide contact with the first and second sliding faces 103 and 104, and the ranges of the fourth through sixth movable contacts 44 to 46 to be brought into slide contact with the fixed contacts 74 to 76 are not brought into slide contact with the third through fifth sliding faces 105 to 107. Therefore even when the sliding faces 103 and 104 are worn and foreign objects are produced because of the sliding contact of the first and third movable contacts 41 and 43 with the sliding faces 103 and 104, the foreign objects can be prevented from being brought onto the fixed contacts 71 through 73. Moreover, even when the sliding faces 105 to 107 are worn and foreign objects are produced because of the sliding contact of the fourth through sixth movable contacts 44 to 46 with the sliding faces 105 to 107, the foreign objects can be prevented from being brought onto the fixed contacts 74 to 76, and the electrical connection reliability can be enhanced.

Meanwhile, the fixed contacts 71 to 76 so arranged as to face to one face side of the base member 56 are integrally provided with the bus bars 51 to 55 embedded in the base member 56, and the other face side of the base member 56 is provided with the opening portions $\mathbf{97}_1$ and $\mathbf{97}_2$ for exposing the flat plate portion 51*a* of the first bus bar 51 to the outside, the opening portions $\mathbf{98}_1$ and $\mathbf{98}_2$ for exposing the flat plate portion 52*a* of the second bus bar 52 to the outside, the opening portions $\mathbf{99}_1$, $\mathbf{99}_3$, $\mathbf{99}_4$, $\mathbf{99}_5$ and $\mathbf{99}_6$ for exposing the first flat plate portion 53*a* of the third bus bar 53 to the outside, the opening portion $\mathbf{99}_2$ for exposing the second flat plate portion 53*c* of the third bus bar 53 to the outside, the opening portion 100 for exposing the flat plate portion 54*a* of the fourth bus bar 54 to the outside, and the opening portion 101 for exposing the flat plate portion 55*a* of the fifth bus bar 55 to the outside.

Therefore, the bus bars 51 to 55 embedded in the base member 56 are positively exposed to the outside on the other face side of the base member 56, and an increase in allowable current can be achieved by improving the heat radiating ability of the bus bars 51 to 55. Further, by providing the plurality of opening portions $\mathbf{97}_1$, $\mathbf{97}_2$, $\mathbf{98}_1$, $\mathbf{98}_2$ and $\mathbf{99}_1$ to $\mathbf{99}_6$, 100 and 101 in the base member 56, the amount of synthetic resin necessary for molding the base member 56 can be reduced. Moreover, in molding the base member 56, the bus bars 51 to 55 can be supported by the opening portions $\mathbf{97}_1$, $\mathbf{97}_2$, $\mathbf{98}_1$, $\mathbf{98}_2$ and $\mathbf{99}_1$ to $\mathbf{99}_6$, 100 and 101, and accordingly, the positions of the bus bars 51 to 55 relative to the base member 56 can be determined more accurately.

Among the bus bars 51 to 55, the first bus bar 51 is integrally provided with the flat plate portion 51*a* along a plane orthogonal to the rotation axis of the rotor 34 and the side plate portion 51*b* orthogonally connected to the inner periphery of the flat plate portion 51*a;* and the third bus bar 53 is integrally provided with the first flat plate portion 53*a* along a plane orthogonal to the rotation axis of the rotor 34, the first side plate portion 53*b* orthogonally connected to the outer periphery of the first flat plate portion 53*a,* the second flat plate portion 53*c* along a plane orthogonal to the rotation axis of the rotor 34, and the second side plate portion 53*d* for orthogonally connecting the inner periphery of the first flat plate portion 53*a* and the outer periphery of the second flat plate portion 53*c*. Accordingly, the surface areas of the both bus bars 51 and 53 are increased, while decreasing the areas occupied by the first and third bus bars 51 and 53 in planes orthogonal to the rotation axis of the rotor 34 comparatively, and the heat radiating ability can be enhanced, while decreasing the areas occupied by the bus bars 51 and 53 comparatively.

The bus bars 51 to 55 embedded in the base member 56 are integrally provided with the terminal portions 77 to 81, and the cross-sections of the terminal portions 77 to 81 are formed of a generally U-shape so as to fit thereto the conductors 120, . . . of the lead wires 115 to 119. Further, the conductors 120, . . . fitted to the respective terminal portions 77 to 81 are bonded to the respective terminal portions 77 to 81 by thermocompression bonding by means of the second planar electrodes 122 for pinching the conductors 120, . . . between the respective terminal portions 77 to 81 and the second electrodes 122. Accordingly, part of the conductors 120, . . . can simply be prevented from being protruded from the terminal portions 77 to 81, firmly pinching the conductors 120, . . . between the terminal portions 77 to 81 and the second electrodes 122, and thereby improving the bonding workability. Further, since the second electrode 122 is of a simple planar shape, the maintenance thereof is facilitated.

Further, the terminal portions 77 to 81 are arranged in parallel at the window 56*d* formed between the base member main portion 56*a* and the holding portion 56*b* of the base member 56, and accordingly, the operation of connecting the fixed contacts 71 to 76 to lead wires 115 to 119 can be carried out efficiently.

Further, the cover 28 is integrally provided with the partition wall 132 for partitioning the area between the portion for connecting the lead wire 115 to the terminal portion 77 and the portion for connecting the lead wire 117 to the terminal portion 79, the partition wall 133 for partitioning the area between the portion for connecting the lead wire 115 to the terminal portion 77 and the portion for connecting the lead wire 118 to the terminal portion 80, the partitioning wall 134 for partitioning the area between the portion for connecting the lead wire 118 to the terminal portion 80 and the portion for connecting the lead wire 119 to the terminal portion 81, and the partitioning wall 135 for partitioning the area between the portion for connecting the lead wire 116 to the terminal portion 78 and the portion for connecting the lead wire 119 to the terminal portion 81. Therefore shortcircuit can be prevented among the respective bonding portions 77 to 81 by the partitioning walls 132 to 135, and the insulation reliability can be improved.

The lead wires 115 to 119 are held in a direction in which an angle to the respective bond faces 82, . . . is formed in a plane orthogonal to the direction of the arrangement of the terminal portions 77 to 81 by the holding portion 56*b* provided to the base member 56. Therefore, tensile load on the lead wires 115 to 119 outside the ignition switch 24 is prevented from directly acting on the portions for bonding the lead wires 115 to 119 to the respective terminal portions 77 to 81, the lead wires 115 to 119 are not repeatedly bent between the holding portion 56*b* and the terminal portions 77 to 81, and accordingly, strict strength of the portions for connecting the conductors 120, . . . of the respective lead wires 115 to 119 to the bonding faces 82, . . . is not necessary.

Further, the conductors 120, . . . of the lead wires 115 to 119 can be directly bonded to the bonding faces 82, . . . of the terminal portions 77 to 81 in a state in which the lead wires 115 to 119 are held by the holding portion 56*b*. Therefore, the positioning of the lead wires 115 to 119 in the bonding is facilitated, and the connection workability can further be enhanced.

Further, the fitting grooves 123, . . . provided in the holding portion 56*b* of the base member 56 and serving to elastically fit and hold the lead wires 115 to 119, each comprises the first groove portion 123*a* opened toward the cover 28 and the second groove portion 123*b* opened to the outside of the base member 56 and connected to the first groove portion 123*a,* forming in a generally L-shape. The cover 28 is integrally provided with the restraining wall 131 for restraining the lead wires 115 to 119 between the cover 28 and the second groove portions 123*b,* . . . of the fitting grooves 123, . . . , by which the lead wires 115 to 119 are firmly restrained at vicinities of the portions for bonding the lead wires 115 to 119 to the terminal portions 77 to 81. Therefore the bonding of the conductors 120, . . . of the lead wires 115 to 119 to the bonding faces 82, . . . can be maintained more firmly.

Further, the cover 28 covering the base member 56 from the side opposite to the rotor 34 is provided with the plurality of heat radiating openings 124, . . . , and accordingly, the ability to radiate the heat from the cover 28 is enhanced, heat is prevented from being accumulated in the space between the cover 28 and the base member 56, and an increase in allowable current flowing through the bus bars 51 to 55 can be achieved. Further, the cover 28 is integrally provided with the bosses 126 to 129 for closing the respective through holes 89 to 92, and accordingly, despite the provision of the heat radiating openings 124, . . . to the cover 28, foreign objects can reliably be prevented from entering the space between the base member 56 and the rotor 34 via the through holes 89 to 92.

As mentioned above, a detailed description has been given of the embodiment of the invention, however, the invention is not limited to the embodiment and various modifications of design can be carried out without deviating from the invention described in the scope of claims.

For example, the invention is applicable not only to the ignition switch 24 but widely to rotary switch devices in which movable contacts are rotated relative to fixed contacts.

What is claimed is:

1. A rotary switch device in which fixed contacts are fixed on one of opposite face sides of a base member made of a synthetic resin, a contact plate in a ring shape is floatingly held by a rotor disposed opposed to the one face side of said base member, movable contacts capable of switching the connection and disconnection to and from said fixed contacts in accordance with the rotation of said rotor are integrally formed at a plurality of places spaced from each other at circumferential intervals on said contacts plate, and sliding faces capable of being brought into slide contact with said moveable contacts are formed on the one of opposite faces of said base member closer to said rotor along a plane orthogonal to a rotation axis of said rotor, wherein said sliding faces are formed on said base member so as to avoid loci which are drawn by portions of said movable contacts to be brought into slide contact with said fixed contacts in accordance with the rotation of said rotor, wherein a plurality of bus bars integrally provided with said fixed contacts are embedded in said base member and a plurality of opening portions for exposing said respective bus bars to an outside are provided in another face of said base member.

2. A rotary switch device according to claim 1, wherein springs for exerting spring forces to bias said movable contacts toward said base member are provided between said contact plate and said rotor, a case made of a synthetic resin being in contact with the one face side of said base member to support said rotor rotatably between said case and said base member is integrally provided with a plurality of leg portions respectively inserted into a plurality of engaging holes provided in said base member, engaging claws engaged with the other of said opposite faces of said base member are projected outward from tip ends of said leg portions, and a cover made of a synthetic resin for covering at least portions where lead wires are connected to said respective fixed contacts on the other face of said base member is integrally provided with a plurality of come-off preventive portions fitted to said respective engaging holes so as to be interposed between said base member and said respective leg portions.

3. A rotary switch device according to claim 1, wherein said plurality of bus bars are integrally provided with terminal portions arranged parallel to each other so as to face the other of said opposite faces of said base member in such a way that conductors of lead wires can directly be bonded to said terminal portions, and a cover made of a synthetic resin for covering at least portions where said lead wires are connected to said respective terminal portions on the other of said opposite face sides of said base member is integrally provided with partitioning walls for partitioning areas where said terminal portions are bonded to said conductors, respectively.

4. A rotary switch device according to claim 1, wherein said plurality of bus bars are integrally provided with terminal portions having bonding faces facing the other of said opposite faces of said base member and arranged parallel to each other in such a way that conductors of lead wires in correspondence with said respective terminal portions can directly be bonded to said bonding faces, and said base member is integrally provided with a holding portion for holding said lead wires in a direction forming an angle to said bonding faces in a plane orthogonal to a direction of an arrangement of said terminal portions.

5. A rotary switch device according to claim 4, wherein portions of said lead wires bonded to said respective terminal portions on the other of said opposite face sides of said base member are covered with a cover made of a synthetic resin, said holding portion is provided with a plurality of fitting grooves each comprising a first groove portion opened to said cover and a second groove portion opened to an outside of said base member and connected to said first groove portion in a generally L-shape in such a way that said respective lead wires can resiliently be fitted therein, and said cover is integrally provided with a restraining wall for restraining said respective lead wires between said cover and at least said second groove portion (123*b*) of said fitting groove.

6. A rotary switch device according to claim 1, wherein said plurality of bus bars are integrally provided with terminal portions, each of said terminal portions has a cross-section formed in a generally U-shape so that conductors of lead wires are fitted to said terminal portions, and said conductors fitted to said terminal portions are bonded to said respective terminal portions by thermocompression bonding using planar electrodes for clamping said conductors between said electrodes and said respective terminal portions.

7. A rotary switch device according to claim 1, wherein said bus bars are integrally provided with flat plate portions along a plane orthogonal to a rotation axis of said rotor and side plate portions orthogonally connected to said flat plate portions, and said flat plate portions are integrally provided with said fixed contacts.

8. A rotary switch device according to claim 1, wherein said plurality of bus bars are connected to each other via connecting portions which are cut in accordance with formation of through holes by punching after molding said base member, a cover for covering said base member from a side opposite to said rotor is provided with a plurality of heat radiating openings, and bosses for closing said through holes are integrally formed with said cover so as to project toward said base member.

* * * * *